US009063472B2

(12) United States Patent
Sengoku et al.

(10) Patent No.: US 9,063,472 B2
(45) Date of Patent: Jun. 23, 2015

(54) IMAGE FORMING APPARATUS AND BELT TENSIONING UNIT

(75) Inventors: Kenji Sengoku, Kanagawa (JP); Ryuuichi Mimbu, Kanagawa (JP); Junpei Fujita, Kanagawa (JP); Osamu Ichihashi, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 219 days.

(21) Appl. No.: 13/415,170

(22) Filed: Mar. 8, 2012

(65) Prior Publication Data

US 2012/0237260 A1 Sep. 20, 2012

(30) Foreign Application Priority Data

Mar. 17, 2011 (JP) ..... 2011-059634
Mar. 17, 2011 (JP) ..... 2011-059639

(51) Int. Cl.
*G03G 15/00* (2006.01)
*G03G 15/16* (2006.01)

(52) U.S. Cl.
CPC ..... *G03G 15/161* (2013.01); *G03G 2215/0129* (2013.01); *G03G 2215/0193* (2013.01); *G03G 2215/1661* (2013.01); *G03G 15/1615* (2013.01)

(58) Field of Classification Search
USPC ..... 399/101, 121, 123
See application file for complete search history.

(56) References Cited

U.S. PATENT DOCUMENTS 6,704,528 B1 * 3/2004 Kawamura et al. ..... 399/123
6,901,234 B2 5/2005 Ogiyama et al.
6,947,693 B2 9/2005 Kamiya et al.
7,474,865 B2 * 1/2009 Chiba et al. ..... 399/101
7,502,583 B2 3/2009 Sawai et al.
7,532,370 B2 5/2009 Kudo et al.
7,616,914 B2 * 11/2009 Otani ..... 399/101
7,742,721 B2 6/2010 Mimbu
7,773,928 B2 8/2010 Ogiyama et al.
8,036,550 B2 10/2011 Minbu
2008/0232867 A1 9/2008 Minbu et al.
2009/0052938 A1 * 2/2009 Sameshima et al. ..... 399/110

(Continued)

FOREIGN PATENT DOCUMENTS

JP 2000-276007 10/2000
JP 2002-54702 2/2002

(Continued)

OTHER PUBLICATIONS

Hosono et al. Machine Translation of JP2007298579A. Published Nov. 2007. Translated Sep. 2013.*

(Continued)

*Primary Examiner* — Philip Marcus T Fadul
(74) *Attorney, Agent, or Firm* — Oblon, McClelland, Maier & Neustadt, L.L.P.

(57) ABSTRACT

An image forming apparatus includes: a belt unit that includes a belt-shaped image carrier stretched around and driven to rotate by a plurality of rollers; a belt tensioning unit that includes a tensioning member that is brought into contact with an image carrying surface of the belt-shaped image carrier and applies tension to the belt-shaped image carrier; and a cleaning unit that includes a cleaning member that is brought into contact with the image carrying surface of the belt-shaped image carrier and cleans the image carrying surface. The cleaning unit is supported by the belt tensioning unit in an attachable and detachable manner.

25 Claims, 14 Drawing Sheets

(56) References Cited

U.S. PATENT DOCUMENTS

| | | | | |
|---|---|---|---|---|
| 2009/0060611 | A1 | 3/2009 | Minbu | |
| 2009/0238603 | A1* | 9/2009 | Kusudo et al. | 399/111 |
| 2009/0279905 | A1* | 11/2009 | Zensai | 399/12 |
| 2009/0279927 | A1 | 11/2009 | Fujita | |
| 2010/0061741 | A1 | 3/2010 | Minbu | |
| 2010/0067952 | A1 | 3/2010 | Fujita et al. | |
| 2010/0142985 | A1 | 6/2010 | Minbe et al. | |
| 2010/0221029 | A1 | 9/2010 | Minbu et al. | |
| 2010/0272478 | A1 | 10/2010 | Ichihashi | |
| 2011/0064487 | A1 | 3/2011 | Ichihashi et al. | |
| 2011/0158690 | A1 | 6/2011 | Mimbu et al. | |
| 2011/0206399 | A1 | 8/2011 | Fujita et al. | |
| 2011/0286759 | A1 | 11/2011 | Ichihashi et al. | |
| 2011/0293312 | A1 | 12/2011 | Mimbu et al. | |
| 2011/0318048 | A1* | 12/2011 | Yasumoto | 399/101 |

FOREIGN PATENT DOCUMENTS

| | | | |
|---|---|---|---|
| JP | 2003-171030 | | 6/2003 |
| JP | 2003-216001 | | 7/2003 |
| JP | 2004-198680 | | 7/2004 |
| JP | 2007-199520 | | 8/2007 |
| JP | 2007-298579 | | 11/2007 |
| JP | 2007298579 | A * | 11/2007 |
| JP | 2009-020238 | | 1/2009 |
| JP | 2011-028059 | | 2/2011 |

OTHER PUBLICATIONS

U.S. Appl. No. 13/369,805, filed Feb. 9, 2012, Fujita, et al.
U.S. Appl. No. 13/417,637, filed Mar. 12, 2012, Sengoku, et al.
Office Action issued Nov. 25, 2014 in Japanese Patent Application No. 2011-059639.
Office Action dated Jan. 6, 2015, in Japanese Application No. 2011-059634.

* cited by examiner

IMAGE FORMING APPARATUS AND BELT TENSIONING UNIT

CROSS-REFERENCE TO RELATED APPLICATIONS

The present application claims priority to and incorporates by reference the entire contents of Japanese Patent Application No. 2011-059634 filed in Japan on Mar. 17, 2011 and Japanese Patent Application No. 2011-059639 filed in Japan on Mar. 17, 2011.

BACKGROUND OF THE INVENTION

1. Field of the Invention

The present invention relates to an image forming apparatus employing an electrostatic copying process, such as a copying machine, a facsimile, a printer, and a belt tensioning unit.

2. Description of the Related Art

Examples of image forming apparatuses using electrophotography include an image forming apparatus using a belt-shaped image carrier. In such an image forming apparatus using a belt-shaped image carrier, the belt-shaped image carrier is stretched around and driven to rotate by a plurality of rollers. However, surging of the belt-shaped image carrier may prevent good image formation. Therefore, appropriate tension is applied to the belt-shaped image carrier by using a belt tensioning unit.

Such a belt tensioning unit includes a tension roller serving as a tensioning member and a pressing unit that presses the tension roller against the belt-shaped image carrier. In an operation of image formation, an image is formed with tension applied to the belt-shaped image carrier. However, if the tension is constantly applied, the tension roller and the belt-shaped image carrier have a heavy load. Therefore, the tension is reduced when no image is formed, and when the belt-shaped image carrier is being replaced, for example. In particular, when removing the belt-shaped image carrier, which is one of expendable supplies, from the rollers, the tension applied to the belt is further reduced compared with the case where no image is formed, whereby the belt-shaped image carrier is separated from the rollers to be replaced.

In Japanese Patent Application Laid-open No. 2000-276007, for example, a tension-reducing unit that reduces tension for attaching and detaching a belt is integrated with a belt tensioning unit. Furthermore, in Japanese Patent Application Laid-open No. 2003-216001 in which a belt-shaped image carrier is used as an intermediate transfer body, for example, an intermediate transfer unit including the intermediate transfer body serving as the belt-shaped image carrier and a plurality of rollers supporting the intermediate transfer body is provided, and a cleaning unit that cleans the intermediate transfer body and a belt tensioning unit that applies tension to the intermediate transfer body are configured by one unit.

If the tension-reducing unit for attaching and detaching the belt is provided to the belt tensioning unit that applies tension to the belt-shaped image carrier as disclosed in Japanese Patent Application Laid-open No. 2000-276007, the configuration of the unit is made complicated and the number of components increases. As a result, the space occupied by the unit is made large. By contrast, if the cleaning unit and the belt tensioning unit are configured by one unit as disclosed in Japanese Patent Application Laid-open No. 2003-216001, the configuration of the unit is made large, and it is difficult to attach and detach the cleaning unit and the belt tensioning unit.

Furthermore, such an image forming apparatus using electrophotography is required to be downsized. Therefore, it is desired to downsize functional components and functional units used for the image forming apparatus, and to reduce the number of components and costs.

In view of the background described above, there is a need to provide an apparatus that facilitates replacement of a unit in a space-saving manner without complicating the configuration.

SUMMARY OF THE INVENTION

It is an object of the present invention to at least partially solve the problems in the conventional technology.

An image forming apparatus includes: a belt unit that includes a belt-shaped image carrier stretched around and driven to rotate by a plurality of rollers; a belt tensioning unit that includes a tensioning member that is brought into contact with an image carrying surface of the belt-shaped image carrier and applies tension to the belt-shaped image carrier; and a cleaning unit that includes a cleaning member that is brought into contact with the image carrying surface of the belt-shaped image carrier and cleans the image carrying surface. The cleaning unit is supported by the belt tensioning unit in an attachable and detachable manner.

A belt tensioning unit provided in a main body of an image forming apparatus includes: a tensioning member that is brought into contact with an image carrying surface of a belt-shaped image carrier that is stretched around and driven to rotate by a plurality of rollers; and a pressing unit that presses the tensioning member against the image carrying surface of the belt-shaped image carrier. The belt tensioning unit includes no tension-reducing unit that releases the belt-shaped image carrier from a pressed state caused by the tensioning member and is attachable to and detachable from one of the main body of the image forming apparatus and a belt unit that includes the belt-shaped image carrier when the image forming apparatus stops an operation.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5A illustrates the contacting state, FIG. 5B illustrates the first separated state, and FIG. 5C illustrates the second separated state;

FIG. 11A is an enlarged view illustrating the supported state by the frame on the front side, and FIG. 11B is an enlarged view illustrating the supported state by the frame on the rear side;

DETAILED DESCRIPTION OF THE PREFERRED EMBODIMENTS

Exemplary embodiments are described below with reference to the accompanying drawings. An entire configuration and operations of an image forming apparatus according to the present embodiment are described first. Subsequently, a configuration of a belt tensioning unit is described.

Embodiments

Figure 1:
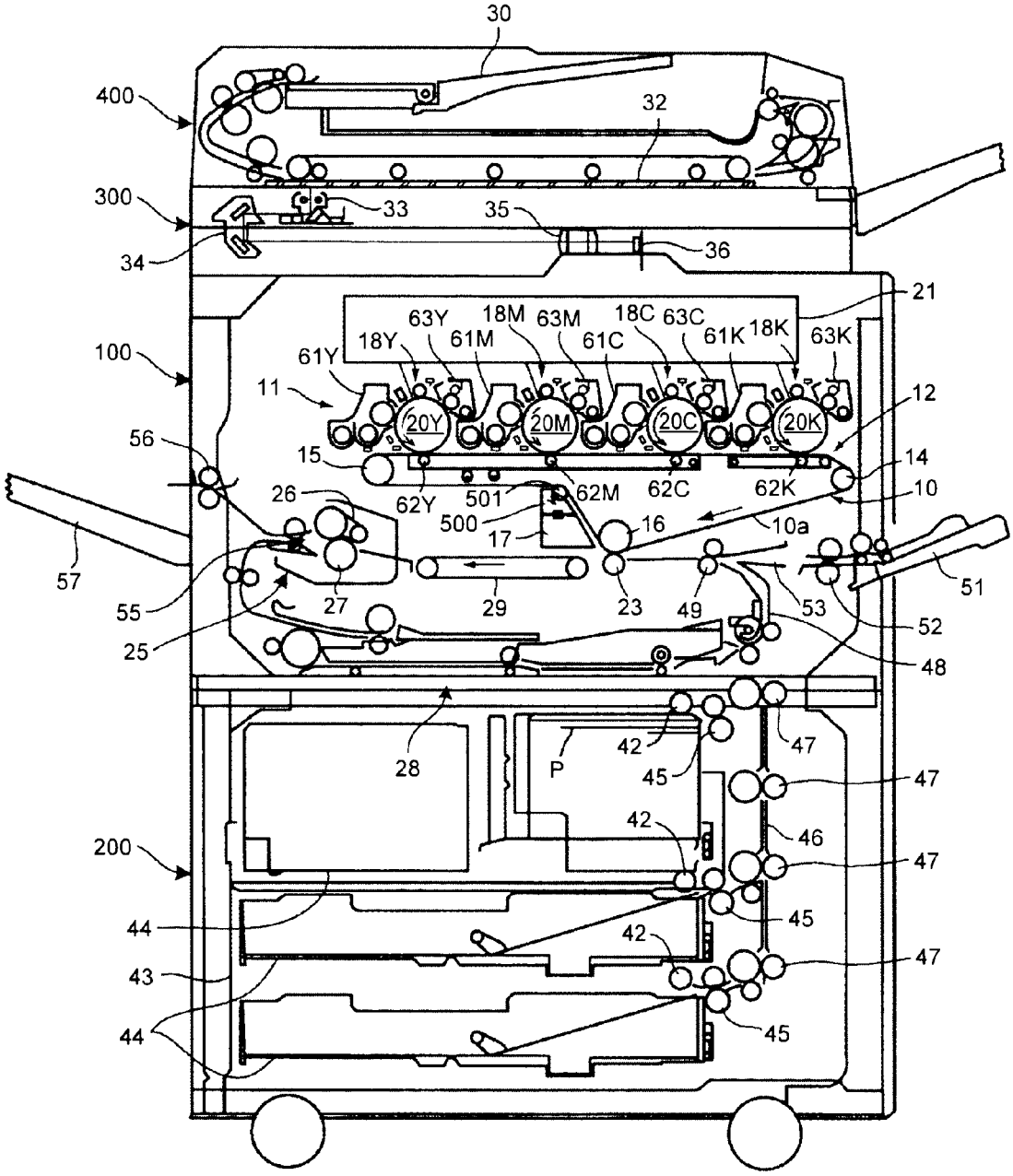
FIG. 1 is a view illustrating a schematic configuration of an aspect of an image forming apparatus according to an embodiment.

An image forming apparatus illustrated in FIG. 1 is an example of a tandem full-color copying machine. The copying machine includes a printer unit 100 serving as the image forming apparatus main body, a paper feeding unit 200 disposed below the printer unit 100, a scanning unit 300 disposed above the printer unit 100, and an automatic document feeder (hereinafter, referred to as an "ADF") 400 disposed above the scanning unit 300. The image forming apparatus is not limited to the copying machine, and may be a printer, a facsimile, or a multifunction peripheral (MFP) having these functions.

The printer unit 100 includes an intermediate transfer belt 10 having a shape of an endless belt and serving as an intermediate transfer body in a center portion thereof. In the present embodiment, the intermediate transfer belt 10 plays the role of a belt-shaped image carrier. The intermediate transfer belt 10 is configured such that a surface thereof is formed by an elastic layer; stretched around a driving roller 14, a driven roller 15, and a secondary transfer facing roller 16 to form an inverted triangular shape when viewed from a side thereof; and is caused to move endlessly in the clockwise direction in FIG. 1 by the rotational driving of the driving roller 14. Four image forming units 18Y, 18M, 18C, and 18K for forming toner images in yellow (Y), magenta (M), cyan (C), and black (K), respectively, are provided above the intermediate transfer belt 10 stretched around the driving roller 14 and the driven roller 15 in an aligned manner along a belt moving direction of the intermediate transfer belt 10.

The image forming units 18Y, 18M, 18C, and 18K include, respectively, photosensitive elements 20Y, 20M, 20C, and 20K in a drum shape serving as latent image carriers; developing units 61Y, 61M, 61C, and 61K; and cleaning units 63Y, 63M, 63C, and 63K for cleaning, respectively, the photosensitive elements 20Y, 20M, 20C, and 20K. The photosensitive elements 20Y, 20M, 20C, and 20K are brought into contact with a belt surface 10*a* serving as an image carrying surface of the intermediate transfer belt 10 so as to form primary transfer nips for the colors of Y, M, C, and K, respectively, and are driven to rotate in the counterclockwise direction in FIG. 1 by a driving unit (not illustrated). The developing units 61Y, 61M, 61C, and 61K develop electrostatic latent images formed on the photosensitive elements 20Y, 20M, 20C, and 20K with toner of Y, M, C, and K, respectively. The cleaning units 63Y, 63M, 63C, and 63K perform cleaning of transfer residual toner sticking to the photosensitive elements 20Y, 20M, 20C, and 20K that have passed through the respective primary transfer nips. In the present copying machine, the four image forming units 18Y, 18M, 18C, and 18K disposed along the belt moving direction configure a tandem image forming unit 11.

In the printer unit 100, an optical writing unit 21 is disposed above the tandem image forming unit 11. The optical writing unit 21 performs optical writing processing by optical scanning on the surfaces of the photosensitive elements 20Y, 20M, 20C, and 20K that are driven to rotate in the counterclockwise direction in FIG. 1, thereby forming electrostatic latent images thereon. The surfaces of the photosensitive elements 20Y, 20M, 20C, and 20K are uniformly charged by charging units of the image forming units 18Y, 18M, 18C, and 18K, respectively, prior to the optical writing processing.

A belt unit 12 serving as an intermediate transfer unit that includes the intermediate transfer belt 10 and the like includes primary transfer rollers 62Y, 62M, 62C, and 62K inside a loop formed by the intermediate transfer belt 10. The primary transfer rollers 62Y, 62M, 62C, and 62K press the intermediate transfer belt 10, from the back side thereof, against the photosensitive elements 20Y, 20M, 20C, and 20K at the primary transfer nips for the colors of Y, M, C, and K, respectively.

A secondary transfer roller 23 serving as a secondary transfer member is provided below the intermediate transfer belt 10. The secondary transfer roller 23 is brought into contact with a stretched portion of the intermediate transfer belt 10 around the secondary transfer facing roller 16 on the belt surface 10*a* side, thereby forming a secondary transfer nip. The secondary transfer facing roller 16 is connected to a voltage applying unit formed by a high-voltage power supply (not illustrated). By applying a transfer bias having the same polarity as the charged polarity of the toner that forms the toner image on the secondary transfer facing roller 16, a transfer electric field is formed between the secondary transfer facing roller 16 and the secondary transfer roller 23 that is grounded. As a result, a yet-to-be-fixed toner image carried on the intermediate transfer belt 10 is collectively secondarily transferred onto a recording medium P in a sheet shape (hereinafter, referred to as a "recording sheet P") fed at a predetermined operational timing at the secondary transfer nip.

The recording sheet P onto which the yet-to-be-fixed toner image is transferred moves from the secondary transfer roller 23 to a conveying belt 29, and is conveyed to a fixing device 25 in a state in which the recording sheet P is sticking to the conveying belt 29. The fixing device 25 applies heat and pressure to the recording sheet P, thereby fixing the toner image. The recording sheet P passing through the fixing device 25 is ejected to a discharge tray 57 by ejecting rollers 56, and is stacked thereon.

The scanning unit 300 reads image information of an original placed on an exposure glass 32 by a scanning sensor 36, and transmits the image information thus read to a control unit (not illustrated), in the printer unit 100. Based on the image information received from the scanning unit 300, the control unit controls a light source, such as a laser diode or a light-emitting diode (LED), in the optical writing unit 21 of the printer unit 100. Then, the control unit causes the light source to emit laser writing light for Y, M, C, and K, thereby optically scanning the photosensitive elements 20Y, 20M, 20C, and 20K. With this optical scanning, the electrostatic latent images are formed on the surfaces of the photosensitive elements 20Y, 20M, 20C, and 20K. The electrostatic latent images are developed into Y, M, C, and K toner images via a predetermined developing process.

The paper feeding unit 200 includes paper feeding rollers 42 that feed the recording sheet P from paper cassettes 44 provided in a multistage manner in a paper bank 43, separating rollers 45 that separate the recording sheets P thus fed, and introduce the recording sheet P to a feed path 46, and carriage rollers 47 that convey the recording sheet P to a feed path 48 of the printer unit 100. With regard to paper feeding, manual feeding can be performed besides the use of the paper feeding unit 200. Therefore, a manual tray 51 used for manual feeding and a separating roller 52 that separates the recording sheets P on the manual tray 51 to be fed to a manual feed path 53 one by one are also provided. The manual feed path 53 joins the feed path 48 in the printer unit 100.

A pair of registration rollers 49 is provided in the vicinity of an end of the feed path 48. The pair of registration rollers 49 nips the recording sheet P conveyed in the feed path 48 between the rollers, and conveys the recording sheet P toward the secondary transfer nip at predetermined operational timing.

To make a photocopy of a color image in the copying machine according to the present embodiment, the original is set on an original table 30 of the ADF 400. Alternatively, the ADF 400 is opened to set the original on the exposure glass 32 of the scanning unit 300, and is closed to press the original. Subsequently, a start switch, which is not illustrated, is pressed. If the original is set on the ADF 400, the original is conveyed to the top of the exposure glass 32. The scanning unit 300 then starts driving, and a first running body 33 and a second running body 34 start running along the surface of the original. Subsequently, light output from a light source in the first running body 33 is reflected by the surface of the original, and reflected light thus obtained is bent toward the second running body 34. The bent light is further bent by a mirror of the second running body 34, and is incident on the scanning sensor 36 through an imaging lens 35. As a result, a content of the original can be read.

When receiving the image information from the scanning unit 300, the printer unit 100 feeds a recording sheet in a size corresponding to the image information to the feed path 48. Furthermore, in association with this operation, the driving roller 14 is driven to rotate by a driving motor, which is not illustrated, thereby causing the intermediate transfer belt 10 to move endlessly in the clockwise direction in FIG. 1. At the same time, the printer unit 100 starts rotational driving of the photosensitive elements 20Y, 20M, 20C, and 20K of the image forming units 18Y, 18M, 18C, and 18K, respectively. Subsequently, the printer unit 100 performs charging processing, the optical writing processing, the developing processing, and the like on the photosensitive elements 20Y, 20M, 20C, and 20K. The Y, M, C, and K toner images formed on the surfaces of the photosensitive elements 20Y, 20M, 20C, and 20K, respectively, by these processing are superimposed sequentially at the primary transfer nips for the colors of Y, M, C, and K. The toner images are primarily transferred onto the belt surface 10*a* of the intermediate transfer belt 10 to be a four-color superimposed toner image.

In the paper feeding unit 200, one of the paper feeding rollers 42 is selectively rotated depending on the size of the recording sheet, and the recording sheets P are fed from one of the paper cassettes 44. The recording sheets P fed therefrom are separated into each sheet by the separating roller 45, and are introduced into the feed path 46. The recording sheet P is then conveyed to the feed path 48 in the printer unit 100 through the carriage rollers 47. When the manual tray 51 is used, the paper feeding roller thereof is driven to rotate, and the separating roller 52 separates the recording sheets P on the manual tray 51. The recording sheet P is then fed to the manual feed path 53, and reaches the vicinity of the end of the feed path 48. In the vicinity of the end of the feed path 48, the recording sheet P stops with the leading edge thereof abutting on the pair of registration rollers 49. Subsequently, when the pair of registration rollers 49 are driven to rotate at operational timing capable of synchronizing with the four-color superimposed toner image on the intermediate transfer belt 10, the recording sheet P is conveyed into the secondary transfer nip, and sticks to the four-color superimposed toner image on the belt. The four-color superimposed toner image is then collectively secondarily transferred onto the recording sheet P under influences of the pressure in the nip, the secondary transfer bias, and the like.

The recording sheet P onto which the four-color superimposed toner image is secondarily transferred at the secondary transfer nip is conveyed into the fixing device 25 by the conveying belt 29. When the recording sheet P is nipped by a fixing nip formed between a pressing roller 27 and a fixing belt 26 in the fixing device 25, the four-color superimposed toner image is fixed onto the surface of the recording sheet P by applying pressure and heat. The recording sheet P on which the color image is formed in this manner is stacked on the discharge tray 57 outside of the apparatus through the pair of ejecting rollers 56.

To perform duplex copying in which another image is formed on the other surface of the recording sheet P, the recording sheet P is ejected from the fixing device 25, and then conveyed to a sheet reversing device 28 by switching the conveying path switched by a switching claw 55. After being reversed, the recording sheet P is returned to the pair of registration rollers 49, and passes through the secondary transfer nip and the fixing device 25 again.

The configuration of the belt unit 12 will be described next.

Figure 2:
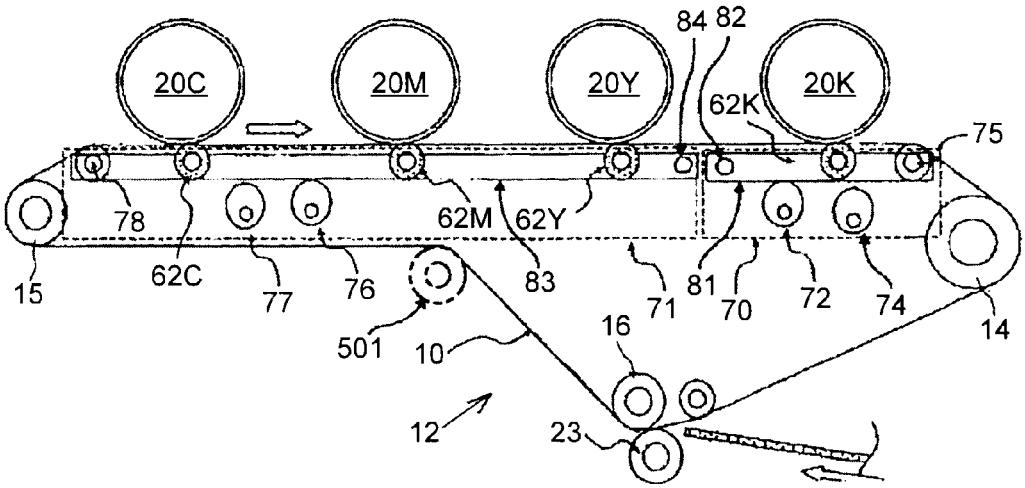
FIG. 2 is a view schematically illustrating an aspect of a belt unit and a tension-reducing unit.

FIG. 2 is an enlarged view of the belt unit 12. The belt unit 12 includes the primary transfer roller 62K serving as a transfer member that transfers a toner image on the photosensitive element 20K for forming a monochrome image onto the intermediate transfer belt 10 and the primary transfer rollers 62Y, 62M, and 62C serving as a plurality of transfer members that transfer toner images on the photosensitive elements 20Y, 20M, and 20C for forming a color image, respectively, onto the intermediate transfer belt 10. The belt unit 12 includes a first position adjusting unit 70 that controls a contacting state and a separated state between the primary transfer roller 62K and the photosensitive element 20K and a second position adjusting unit 71 that controls a contacting state and a separated state between the primary transfer rollers 62Y, 62M, and 62C and the photosensitive elements 20Y, 20M, and 20C, respectively. In the present embodiment, the first and second position adjusting units 70 and 71 function as tension-reducing units that reduce tension applied to the intermediate transfer belt 10.

Figure 6:
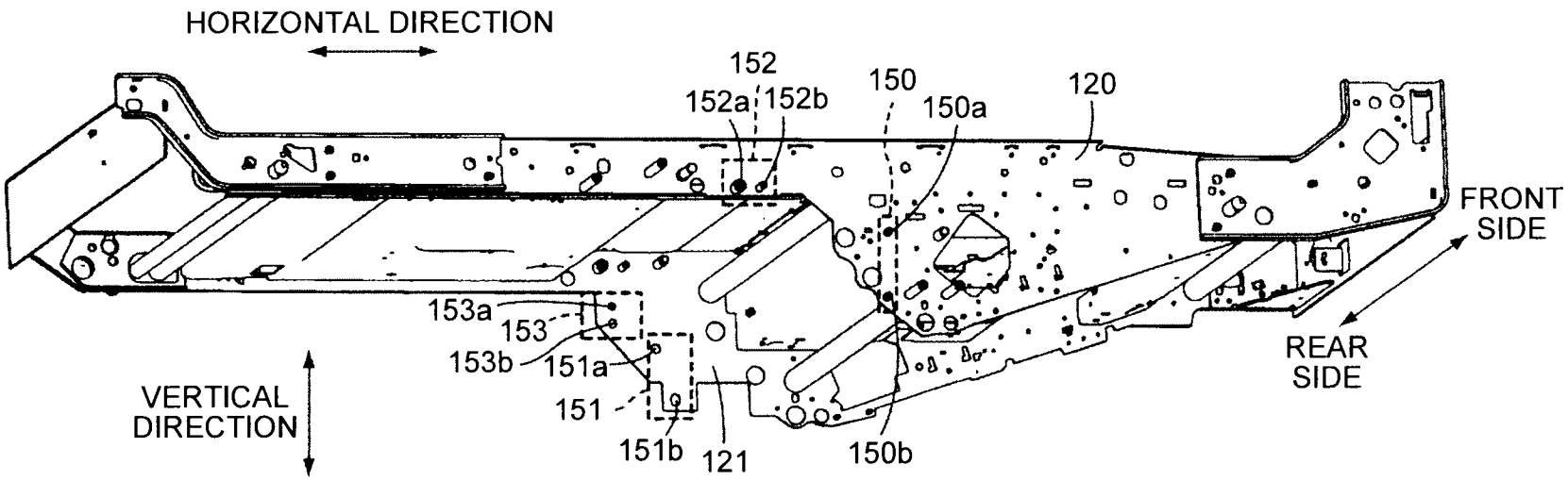
FIG. 6 is a perspective view of a configuration of frames included in the belt unit.

The primary transfer rollers 62K, 62Y, 62M, and 62C, the driving roller 14, the driven roller 15, and the secondary transfer facing roller 16 illustrated in FIG. 1, and the first and second position adjusting units 70 and 71 are supported by a pair of first and second frames 120 and 121 illustrated in FIG. 6. The first and second frames 120 and 121 made of metal are provided, respectively, on the front side and the rear side of the printer unit 100 used for recording in the width direction of the recording sheet P with a space interposed therebetween. The first and second frames 120 and 121 are integrated with each other by a plurality of connecting members. A cleaning unit 17 and a belt tensioning unit 500, which will be described later, are supported by the first and second frames 120 and 121 in an attachable and detachable manner. The first frame 120 also functions as an attachment unit for first, second, and third inner covers 601, 602, and 603, which will be described later, attached to the printer unit 100.

The belt unit 12 can be attached to and detached from the printer unit 100 after a tension reducing operation in which the first and second position adjusting units 70 and 71 cause the photosensitive elements 20Y, 20M, 20C, and 20K and the primary transfer rollers to be located at a second separated position, which will be described later.

In the present embodiment, the belt unit 12, the cleaning unit 17, and the belt tensioning unit 500 are attached to and detached from the front side of the printer unit 100, that is, from the first frame 120 side. In the present embodiment, an attachment direction is a direction pointing from the front side to the rear side of the printer unit 100 unless otherwise noted. By contrast, a detachment direction is a direction pointing from the rear side to the front side of the printer unit 100 unless otherwise noted.

The first position adjusting unit 70 includes a supporting member 81, a first cam 72, and a second cam 74. The supporting member 81 is in a plate shape or a rectangular frame shape, and supports the primary transfer roller 62K and a downstream backup roller 75 in a rotatable manner. The supporting member 81 is provided in a rotatable manner in a direction to be brought into contact with and separated from the inner surface of the intermediate transfer belt 10 about a rotation fulcrum 82 provided at a position upstream of the primary transfer roller 62K in the belt moving direction provided inside the transfer belt 10.

In the first position adjusting unit 70, the primary transfer roller 62K and the downstream backup roller 75 are provided between the driving roller 14 and the driven roller 15 whose positions are fixed with respect to the intermediate transfer belt 10. With this configuration, use of the supporting member 81 facilitates adjusting the positions of the primary transfer roller 62K and the downstream backup roller 75. In the present embodiment, the supporting member 81 rotates about the rotation fulcrum 82, thereby causing the primary transfer roller 62K and the downstream backup roller 75 to move in association with the rotation thereof. As a result, it is possible to adjust the position of the intermediate transfer belt 10 with respect to the photosensitive element 20K. The downstream backup roller 75 is disposed downstream of the primary transfer roller 62K in the belt moving direction of the intermediate transfer belt 10. The downstream backup roller 75 functions as a roller that makes the nip amounts at the primary transfer nips the same for all the colors.

As illustrated in FIG. 2, the first cam 72 and the second cam 74 are provided on the lower side in FIG. 2 than the supporting member 81. The state illustrated in FIG. 2 is a contacting state in which the first cam 72 supports the supporting member 81 at the top dead point, thereby causing the intermediate transfer belt 10 to be brought into contact with the photosensitive element 20K. By rotating the first cam 72 and the second cam 74, the supporting member 81 rotates about the rotation fulcrum 82. In association with this rotation, the primary transfer roller 62K and the downstream backup roller 75 can be moved. Furthermore, by controlling the rotation and stop positions of the first cam 72 and the second cam 74 individually, it is possible to perform two-stage rotational operation (two operations from the contacting state to a first separated state and from the first separated state to a second separated state). The rotational operation at the first stage creates the first separated state by separating the intermediate transfer belt 10 from the photosensitive element 20K. Furthermore, the rotational operation at the second stage creates the second separated state, thereby reducing the winding amount around the downstream backup roller 75 and reducing the belt tension sequentially. The first cam 72 and the second cam 74 are disposed side by side. However, the second cam 74 is disposed lower than the first cam 72 in the vertical direction such that the position of the top dead point of the second cam 74 is located higher than the position of the bottom dead point of the first cam 72.

With this arrangement, the supporting member 81 is supported at the top dead point of the first cam 72 in the contacting state, supported at the top dead point of the second cam 74 in the first separated state, and supported at the bottom dead point of the first cam 72 or the second cam 74 in the second separated state.

In the description below, the positions of the intermediate transfer belt and the transfer rollers in the contacting state, the first separated state, and the second separated state are referred to as a "contact position", a "first separated position", and a "second separated position", respectively. Furthermore, the intermediate transfer belt 10, the primary transfer rollers, and the like are located at the second separated position when the apparatus stops an operation.

Figure 3:
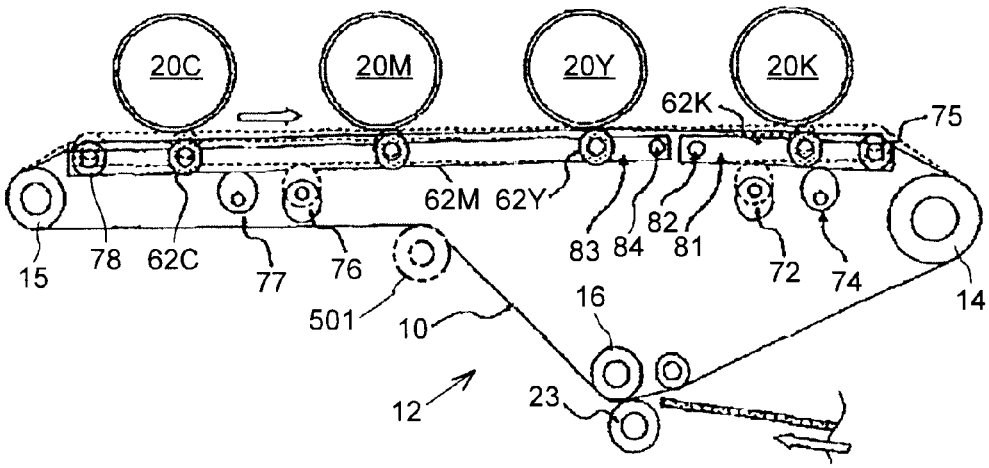
FIG. 3 is an explanatory diagram schematically illustrating a movement operation of the belt unit from a contacting state to a first separated state.

FIG. 3 is an enlarged view of the belt unit 12 illustrating the first separated state in which the intermediate transfer belt 10 is separated from the photosensitive elements 20 (Y, M, C, and K) by moving the primary transfer rollers 62 (Y, M, C, and K), respectively. An explanation will be given of the primary transfer roller 62K disposed at a position opposite to the photosensitive element 20K that forms a monochrome image. In order to shift the primary transfer roller 62K from the contact position illustrated in FIG. 2 to the first separated position illustrated in FIG. 3, the first cam 72 located at the position of the top dead point is rotated by 180 degrees by driving force of a driving unit, such as a motor or a solenoid, which is not illustrated, and is stopped at the position of the bottom dead point. As a result, in association with the rotation of the first cam 72, the supporting member 81 rotates in the clockwise direction in FIG. 3 about the rotation fulcrum 82 together with the primary transfer roller 62K and the downstream backup roller 75 by the belt tension and the own weight of the supporting member 81. Before the first cam 72 reaches the bottom dead point, the supporting member 81 is brought into contact with the top dead point of the second cam 74 to be positioned.

Figure 4:
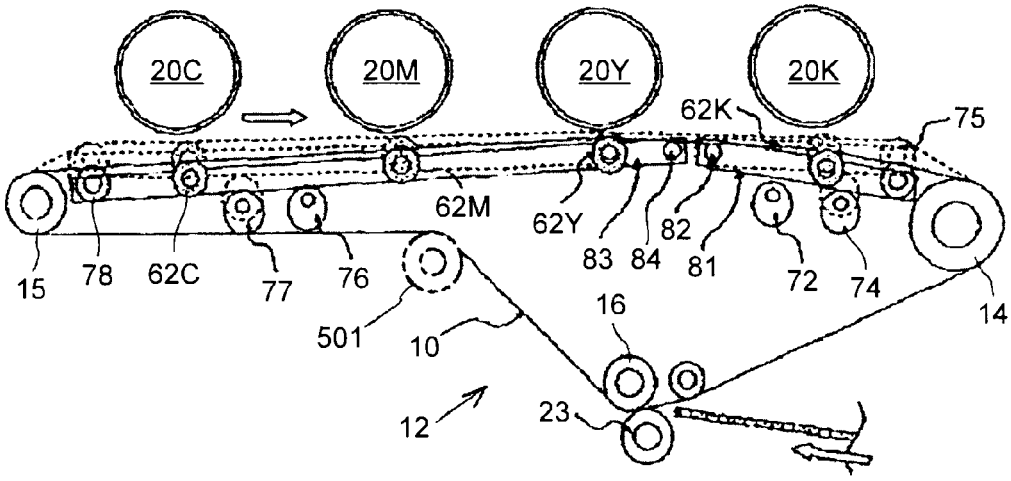
FIG. 4 an explanatory diagram schematically illustrating a movement operation of the belt unit from the first separated state to a second separated state.

FIG. 4 is an enlarged view of the belt unit 12 illustrating the second separated state in which the intermediate transfer belt 10 is further separated from the photosensitive elements 20 (Y, M, C, and K) than the first separated state illustrated in FIG. 3 by further moving the primary transfer rollers 62 (Y, M, C, and K), respectively. An explanation will be given of the primary transfer roller 62K disposed at the position opposite to the photosensitive element 20K that forms a monochrome image. In order to shift the primary transfer roller 62K from the first separated position illustrated in FIG. 3 to the second separated position illustrated in FIG. 4, the second cam 74 is rotated by 180 degrees by manually operating an operation lever 700, which will be described below, and is stopped at the position of the bottom dead point. In association with the rotation of the second cam 74, the supporting member 81 further rotates in the clockwise direction in FIG. 4 about the rotation fulcrum 82 together with the primary transfer roller 62K and the downstream backup roller 75 by the belt tension and the own weight of the supporting member 81. The supporting member 81 is then positioned at the bottom dead point of the first cam 72. At the second separated position, the intermediate transfer belt 10 is further separated from the photosensitive element 20K than at the first separated position. The point with which the supporting member 81 is supported at the second separated position is not limited to the bottom dead point of the first cam 72, and may be the bottom dead point of the second cam 74.

As described above, rotation of the first cam 72 causes the primary transfer roller 62K supported by the supporting member 81 to move, making it possible to control the position of the primary transfer roller 62K between the contact position and the first separated position. Furthermore, rotation of the second cam 74 makes it possible to control the position of the primary transfer roller 62K between the first separated position and the second separated position. In addition, the downstream backup roller 75 also moves in association with the supporting member 81, and is controlled to be located at the contact position, the first separated position, and the second separated position. As a result of such positioning control, it is possible to increase and decrease the tension applied to the intermediate transfer belt 10.

As illustrated in FIG. 2, the second position adjusting unit 71 for colors includes a supporting member 83, a first cam 76, and a second cam 77. The supporting member 83 is in a plate shape or a rectangular frame shape, and supports the primary transfer rollers 62Y, 62M, and 62C and an upstream backup roller 78 in a rotatable manner. The supporting member 83 is provided in a rotatable manner in a direction to be brought into contact with and separated from the inner surface of the intermediate transfer belt 10 about a rotation fulcrum 84 disposed at a position downstream of the primary transfer roller 62Y in the belt moving direction inside the intermediate transfer belt 10.

The second position adjusting unit 71 is configured by disposing the primary transfer rollers 62Y, 62M, and 620 and the upstream backup roller 78 between the driving roller 14 and the driven roller 15 whose positions are fixed with respect to the intermediate transfer belt 10. With this configuration, use of the supporting member 83 facilitates adjusting the positions of the primary transfer rollers 62Y, 62M, and 620 and the upstream backup roller 78. In the present embodiment, the supporting member 83 rotates about the rotation fulcrum 84, thereby causing the primary transfer rollers 62Y, 62M, and 62C and the upstream backup roller 78 to move in association with the rotation thereof. As a result, it is possible to adjust the position of the intermediate transfer belt 10 with respect to the photosensitive elements 20Y, 20M, and 20C. The upstream backup roller 78 is disposed upstream of the primary transfer roller 620 in the moving direction of the intermediate transfer belt 10. The upstream backup roller 78 functions as a roller that makes the nip amounts at the primary transfer nips the same for all the colors.

The first cam 76 and the second cam 77 are disposed on the lower side in FIG. 2 than the supporting member 83. The state illustrated in FIG. 2 is a contacting state in which the first cam 76 supports the supporting member 83 at the top dead point, thereby causing the intermediate transfer belt 10 to be brought into contact with the photosensitive elements 20Y, 20M, and 20C. By rotating the first cam 76 and the second cam 77, the supporting member 83 rotates about the rotation fulcrum 84. In association with this rotation, the primary transfer rollers 62Y, 62M, and 62C and the upstream backup roller 78 can be moved. Furthermore, by controlling the stopping positions in the rotation of the first cam 76 and the second cam 77 individually, it is possible to perform two-stage rotational operation (two operations from the contacting state to the first separated state and from the first separated state to the second separated state). The rotational operation at the first stage causes the intermediate transfer belt 10 to be separated from the photosensitive elements 20Y, 20M, and 20C. Furthermore, the rotational operation at the second stage reduces the winding amount around the upstream backup roller 78, thereby reducing the belt tension sequentially.

The first cam 76 and the second cam 77 are disposed side by side. However, the second cam 77 is disposed lower than the first cam 76 in the vertical direction such that the position of the top dead point of the second cam 77 is located higher than the position of the bottom dead point of the first cam 76. With this arrangement, the supporting member 83 is supported at the top dead point of the first cam 76 in the contacting state, supported at the top dead point of the second cam 77 in the first separated state, and supported at the bottom dead point of the first cam 76 or the second cam 77 in the second separated state.

In order to shift the primary transfer rollers 62Y, 62M, and 62C from the contact position illustrated in FIG. 2 to the first separated position illustrated in FIG. 3, the first cam 76 located at the position of the top dead point is rotated by 180 degrees by driving force of a driving unit, such as a motor or a solenoid, which is not illustrated, and is stopped at the position of the bottom dead point. As a result, in association with the rotation of the first cam 76, the supporting member 83 rotates in the counterclockwise direction in FIG. 3 about the rotation fulcrum 84 together with the primary transfer rollers 62Y, 62M, and 62C and the upstream backup roller 78 by the belt tension and the own weight of the supporting member 83. Before the first cam 76 reaches the bottom dead point thereof, the supporting member 83 is brought into contact with the top dead point of the second cam 77 to be positioned.

In order to shift the primary transfer rollers 62Y, 62M, and 62C from the first separated position illustrated in FIG. 3 to the second separated position illustrated in FIG. 4, the second cam 77 is rotated by 180 degrees by manually operating the operation lever 700, which will be described below, and is stopped at the position of the bottom dead point. In association with the rotation of the second cam 77, the supporting member 83 further rotates in the counterclockwise direction in FIG. 4 about the rotation fulcrum 84 together with the primary transfer rollers 62Y, 62M, and 62C and the upstream backup roller 78 by the belt tension and the own weight of the supporting member 83. The supporting member 83 is then positioned at the bottom dead point of the first cam 76. At the second separated position, the intermediate transfer belt 10 is further separated from the photosensitive elements 20Y, 20M, and 20C than at the first separated position. The point with which the supporting member 83 is supported at the second separated position is not limited to the bottom dead point of the first cam 76, and may be the bottom dead point of the second cam 77.

As described above, rotation of the first cam 76 causes the primary transfer rollers 62Y, 62M, and 62C supported by the supporting member 83 to move, making it possible to control the positions of the primary transfer rollers 62Y, 62M, and 62C between the contact position and the first separated position. Furthermore, rotation of the second cam 77 makes it possible to control the positions of the primary transfer rollers 62Y, 62M, and 62C between the first separated position and the second separated position. In addition, the upstream backup roller 78 also moves in association with the supporting member 83, and is controlled to be located at the contact position, the first separated position, and the second separated position. As a result of such positioning control, it is possible to increase and decrease the tension applied to the intermediate transfer belt 10.

In the present embodiment, in the contacting state, the two backup rollers 75 and 78, the primary transfer roller 62K for black, and the primary transfer rollers 62C, 62M, and 62Y for colors are brought into contact with the intermediate transfer belt 10 approximately on a same plane. With the two backup rollers 75 and 78, it is possible to make the transfer nip amounts the same for all the transfer nips when printing is performed by using all the photosensitive elements 20Y, 20M, 20C, and 20K and the primary transfer rollers 62Y, 62M, 62C, and 62K (when full-color printing is performed). In particular, as illustrated in FIG. 2, the upstream backup roller 78 prevents the intermediate transfer belt 10 from inclining toward the driven roller 15 upstream of the photosensitive element 20C. By contrast, the downstream backup roller 75 prevents the intermediate transfer belt 10 from inclining toward the driving roller 14 downstream of the photosensitive element 20K.

In the present embodiment, the rotation fulcrum 82 of the first position adjusting unit 70 and the rotation fulcrum 84 of the second position adjusting unit 71 are disposed between the primary transfer roller 62K for black and the primary transfer rollers 62Y, 62M, and 62C for colors. This configuration facilitates causing one of the black image forming section (the photosensitive element 20K and the primary transfer roller 62K) and the color image forming section (the photosensitive elements 20Y, 20M, and 20C, and the primary transfer rollers 62Y, 62M, and 62C) to be in the separated state.

Furthermore, when the first and second position adjusting units 70 and 71 cause the intermediate transfer belt 10 and the primary transfer rollers to be located at the second separated position, the belt tension is set the lowest. As a result, it is possible to perform an attachment and detachment operation in a simple manner when replacing the intermediate transfer belt 10 and when attaching and detaching the belt tensioning unit 500, which will be described later.

The belt unit 12 is set in the contacting state and the first separated state in printing and in a printing standby mode. Therefore, in view of normal usage of the copying machine (the case where the printing and the standby operation are performed repeatedly with the copying machine turned ON), it is preferable that position adjustment be automatically performed by a driving unit. By contrast, the belt unit 12 is set in the second separated state when attaching and detaching the belt unit 12 and the image forming units 18Y, 18M, 18C, and 18K illustrated in FIG. 1 which include the respective photosensitive elements 20Y, 20M, 20C, and 20K. It is assumed that the second separated state is created mainly for maintenance of the apparatus, such as replacement of the intermediate transfer belt 10 and the photosensitive elements 20Y, 20M, 20C, and 20K. The position adjusting operation in the second separated state is performed much less frequently than the position adjusting operation between the contacting state and the first separated state. Therefore, it is preferable that the adjustment be manually performed with the operation lever 700 and the like without providing a driving unit for the position adjusting operation in the second separated state in consideration of manufacturing costs for the apparatus.

The first separated position is set to a position at which the primary transfer rollers 62Y, 62M, 62C, and 62K are close to the photosensitive elements 20Y, 20M, 20C, and 20K, respectively, regardless of the attachability and detachability of the belt unit 12 or the image forming units 18Y, 18M, 18C, and 18K. Furthermore, fluctuations in the running path of the intermediate transfer belt 10 are small while the intermediate transfer belt 10 is being brought into contact with and separated from the photosensitive elements 20Y, 20M, 20C, and 20K. As a result, fluctuations in the belt tension can be suppressed, whereby predetermined belt tension is applied to the intermediate transfer belt 10. Therefore, it is possible to prevent a deviation from occurring in the position control of the intermediate transfer belt 10 in the width direction. Furthermore, it is possible to prevent the intermediate transfer belt 10 from loosening and slipping while being driven.

The second separated position is set such that the intermediate transfer belt 10 is widely separated from the photosensitive elements 20Y, 20M, 20C, and 20K regardless of the fact that the fluctuations in the belt tension make meandering control of the intermediate transfer belt 10 unstable. As a result, the attachability and detachability of the belt unit 12 (especially, the intermediate transfer belt 10, the driving roller 14, the driven roller 15, and the secondary transfer facing roller 16) and the image forming units 18Y, 18M, 18C, and 18K is extremely excellent.

In the configuration according to the present embodiment, the moving distances of the primary transfer rollers 62Y 62M, 62C, and 62K, the downstream backup roller 75, and the upstream backup roller 78 are set small between the contacting state and the first separated state. The downstream backup roller 75 and the upstream backup roller 78 have smaller winding amounts of the intermediate transfer belt 10 and are applied with smaller belt tension than the driving roller 14 and the driven roller 15. As a result, the driving components that perform the contacting and separating operation (the first cam 72 and the first cam 76) have a small load. Furthermore, the fluctuations in the belt tension between the contacting state and the first separated state can be set small.

The moving distances of the primary transfer rollers 62Y, 62M, 62C, and 62K, the downstream backup roller 75, and the upstream backup roller 78 are set large between the first separated state and the second separated state. In the second separated state, it is not necessary to secure the belt tension, and each of the photosensitive elements 20Y, 20M, 20C, and 20K and the intermediate transfer belt 10 are widely separated. As a result, the attachability and detachability of the photosensitive elements 20Y, 20M, 20C, and 20K and the intermediate transfer belt 10 is excellent. As illustrated in FIG. 4, in the configuration according to the present embodiment, the belt winding amounts around the downstream backup roller 75 and the upstream backup roller 78 are reduced in the second separated state, thereby reducing the tension of the intermediate transfer belt 10 significantly. This configuration facilitates removing the intermediate transfer belt 10 from the rollers after the belt unit 12 is separated from the photosensitive elements 20Y, 20M, 20C, and 20K. The belt unit 12 includes the intermediate transfer belt 10, the primary transfer rollers 62Y, 62M, 62C, and 62K, the driving roller 14, the driven roller 15, the secondary transfer facing roller 16, and the downstream backup roller 75 and the upstream backup roller 78.

Figure 5A:
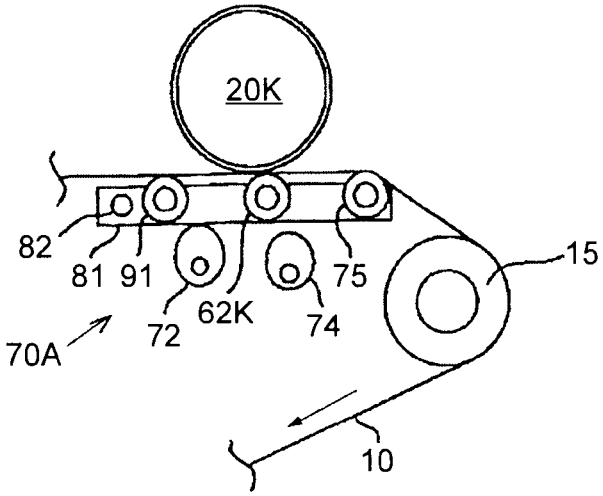
FIGS. 5A to 5C are views schematically illustrating a tension-reducing unit of a belt unit according to another embodiment.
Figure 5B:
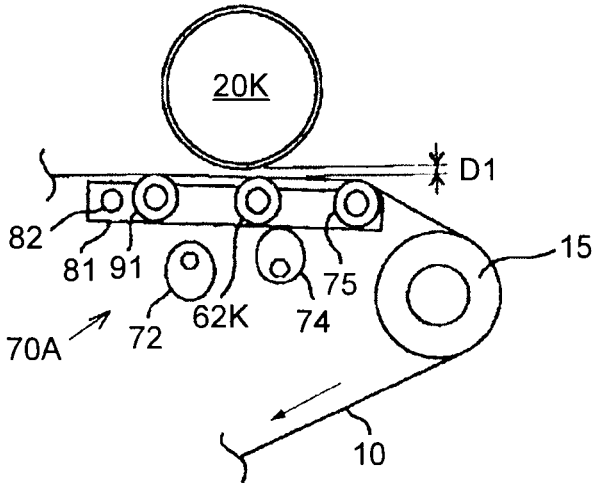
Figure 5C:
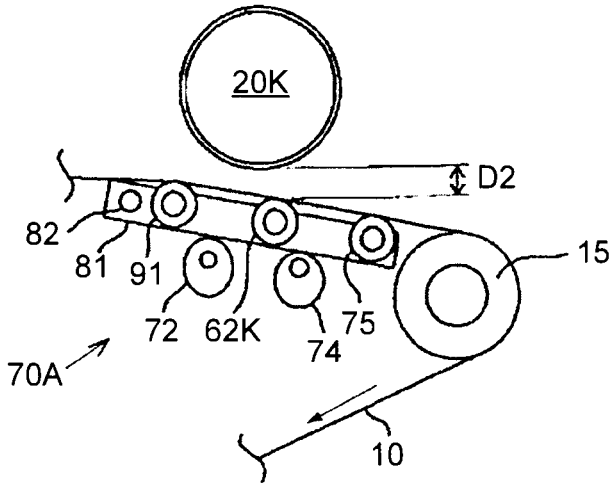

FIGS. 5A to 5C are views illustrating another embodiment of the position adjusting unit functioning as a tension-reducing unit, and schematically illustrating the separated state of the belt unit (intermediate transfer unit) 12. FIG. 5A illustrates the contacting state, FIG. 5B illustrates the first separated state, and FIG. 5C illustrates the second separated state. A position adjusting unit 70A serving as a separating unit according to the present embodiment is different from the first position adjusting unit 70 in that an auxiliary roller 91 is provided at a position upstream of the primary transfer roller 62K in the moving direction of the intermediate transfer belt 10. The auxiliary roller 91 is supported by the supporting member 81 in a rotatable manner at the position closer to the rotation fulcrum 82 between the rotation fulcrum 82 and the primary transfer roller 62K. In the contacting state illustrated in FIG. 5A, the auxiliary roller 91 and the primary transfer roller 62K are brought into contact with the intermediate transfer belt 10 without causing the intermediate transfer belt 10 to wind therearound. By contrast, in the separated states illustrated in FIGS. 5B and 5C, the intermediate transfer belt 10 winds around the auxiliary roller 91.

In these states, because the auxiliary roller 91 supports the intermediate transfer belt 10 just above the rotation fulcrum 82, the rotation fulcrum 82 and the intermediate transfer belt 10 are not brought into contact with each other. By arranging the auxiliary roller 91 in this manner, it is possible to increase the flexibility in the arrangement of the rotation fulcrum 82 and the rollers. Furthermore, the primary transfer roller 62K is disposed between the auxiliary roller 91 and the downstream backup roller 75, and these components move in tandem with one another while maintaining the positional relationship of being aligned as illustrated in FIGS. 5A to 5C. As a result, the intermediate transfer belt 10 does not wind around the primary transfer roller 62K. The primary transfer roller 62K that affects the transfer accuracy has no load caused by the intermediate transfer belt 10 winding therearound. Therefore, it is possible to prevent a support shaft of the primary transfer roller 62K from being distorted or deformed.

An example of setting the separation distance between the photosensitive element 20K and the primary transfer roller 62K will now be described with reference to FIGS. 5A to 5C. The contacting state is set as illustrated in FIG. 5A such that the distance from the rotation fulcrum 82 to the downstream backup roller 75 is 200 mm, and the distance from the rotation fulcrum 82 to the primary transfer roller 62K is 130 mm, for example. By rotating the first cam 72 by 180 degrees from the contacting state, the position at which the supporting member 81 is brought into contact with the first cam 72 is moved downward in a nearly vertical direction. The supporting member 81 is then brought into contact with the top dead point of the second cam 74. This state is the first separated state illustrated in FIG. 5B. Separation distance D1 between the photosensitive element 20K and the primary transfer roller 62K is 4 mm at this time, for example.

Furthermore, by rotating the second cam 74 by 180 degrees from the first separated state, the position at which the supporting member 81 is in contact with the second cam 74 is moved downward in a nearly vertical direction. The supporting member 81 is then brought into contact with the bottom dead point of the first cam 72. This state is the second separated state illustrated in FIG. 5C in which the separation amount is larger than that in the first separated state. Separation distance D2 between the photosensitive element 20K and the primary transfer roller 62K is 17 mm at this time, for example.

The winding amount of the intermediate transfer belt 10 around the downstream backup roller 75 and the belt tension of the intermediate transfer belt 10 are the largest in the contacting state, the second largest in the first separated state, and the third largest in the second separated state. In the first separated state, the separation distance D1 is set to a small value of 4 mm, for example. Therefore, differences in the winding amount around the downstream backup roller 75 and the belt tension as compared with those in the contacting state are small. By contrast, in the second separated state, the separation distance D2 is set to a larger value of 17 mm, for example. As a result, the winding amount of the belt around the downstream backup roller 75 is reduced, and the belt tension is also reduced.

In the present embodiment, explanations have been given of the configuration in which the auxiliary roller 91 is provided to the supporting member 81 for black. However, a similar auxiliary roller may also be provided to the supporting member 83 for colors.

The cleaning unit 17 and the belt tensioning unit 500 will now be described. The cleaning unit 17 and the belt tensioning unit 500 are disposed inside the printer unit 100. The cleaning unit 17 is disposed at a position after the intermediate transfer belt 10 passes through the secondary transfer nip and before the intermediate transfer belt 10 enters the primary transfer nip for the color of Y located on the uppermost stream in the primary transfer process among the four colors. In other words, the cleaning unit 17 is disposed between the driven roller 15 and the secondary transfer facing roller 16. The cleaning unit 17 removes transfer residual toner and paper powder sticking to the belt surface 10*a* after the secondary transfer process is finished.

Figure 7:
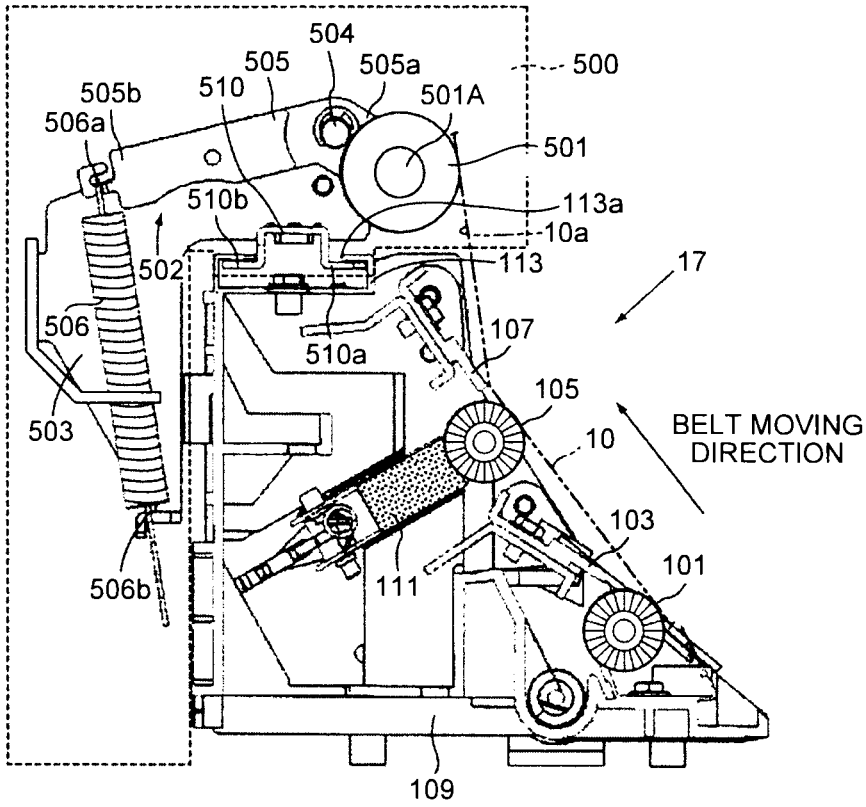
FIG. 7 is an enlarged view of a schematic configuration of a belt tensioning unit and a cleaning unit according to the present embodiment viewed from a front side of the apparatus.
Figure 8:
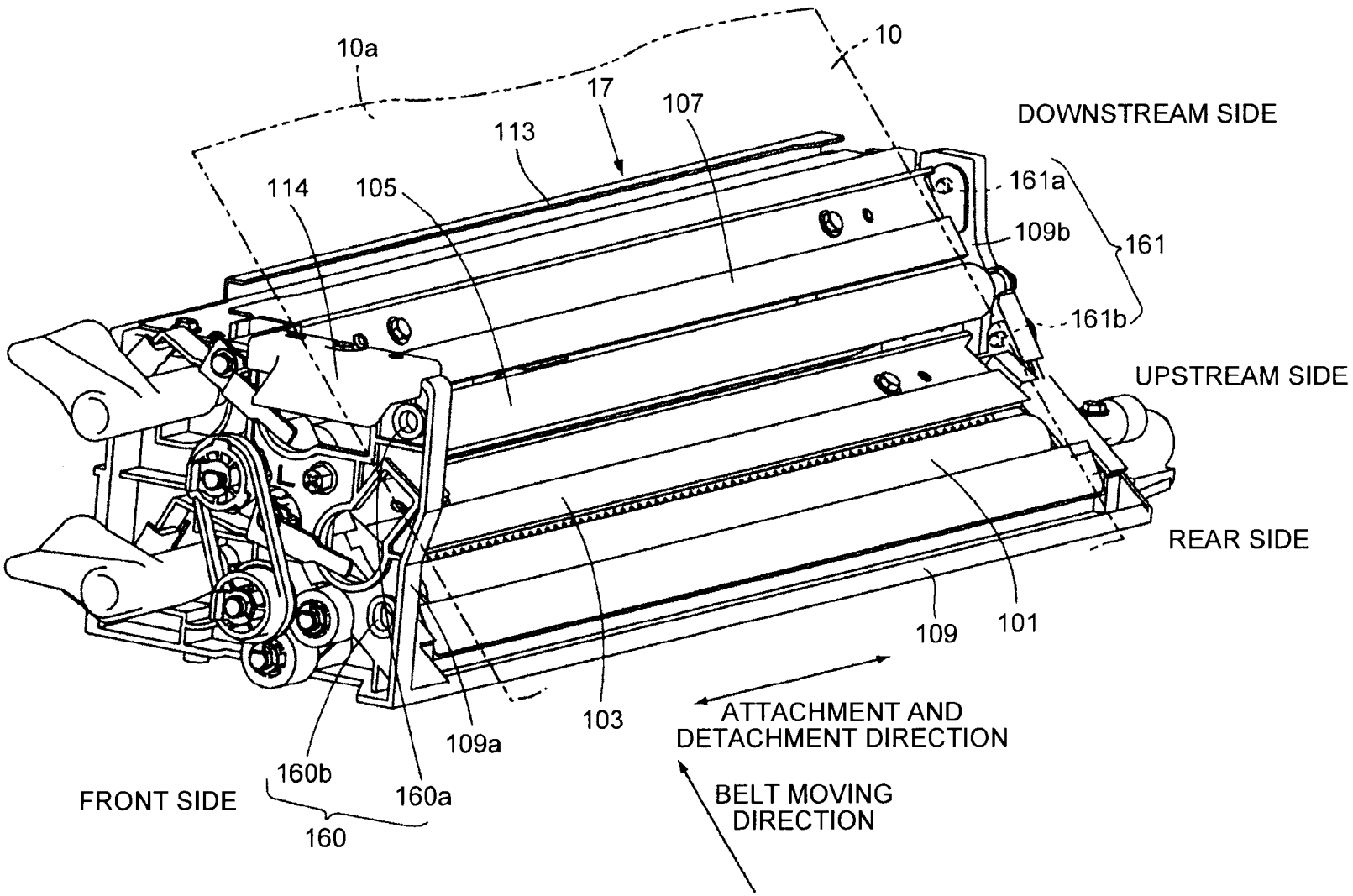
FIG. 8 is a perspective view of a configuration of the cleaning unit.

As illustrated in FIGS. 7 and 8, the cleaning unit 17 includes a brush roller 101 serving as a cleaning member, a cleaning blade 103 serving as another cleaning member, an application brush roller 105 serving as a lubricant applying member, and a leveling blade 107 serving as a lubricant leveling member, which are disposed in order from the upstream side to the downstream side in the moving direction of the belt surface 10*a* of the intermediate transfer belt 10 by being supported by a unit frame 109. The brush roller 101, the cleaning blade 103, the application brush roller 105, and the leveling blade 107 are disposed so as to be brought into contact with the belt surface 10*a*.

The brush roller 101 is supported by the unit frame 109 in a rotatable manner, and has a function to brush off the paper powder and the transfer residual toner sticking to the belt surface 10*a* by rotation. While the brush roller 101 may be dragged to rotate by the intermediate transfer belt 10, the brush roller 101 is driven to rotate by a belt drive in the present embodiment. Polyethylene terephthalate (PET) resin is used herein as the material of the bristles of the brush.

By arranging the brush roller 101 upstream of the cleaning blade 103 in the belt moving direction, it is possible to remove the transfer residual toner as well as the paper powder. Therefore, it is possible to enjoy advantageous effects in that the load on the cleaning blade 103 is reduced, and the lifetime of the cleaning blade 103 is extended.

The cleaning blade 103 made of a rubber plate material represented by a polyurethane rubber is a well-known component that sweeps the paper powder and the transfer residual toner sticking to the belt surface 10*a* by movement of the intermediate transfer belt 10.

The application brush roller 105 is supported by the unit frame 109 in a rotatable manner, and the brush part thereof is brought into contact with an end surface of a solid lubricant 111 and the belt surface 10*a*. The application brush roller 105 is driven to rotate by a driving unit, which is not illustrated, thereby scraping off the solid lubricant 111, and applying the solid lubricant 111 to the belt surface 10*a*. As a result, the application brush roller 105 increases the smoothness of the belt surface. The leveling blade 107 levels out the thickness of the lubricant applied to the belt surface 10*a* by the application brush roller 105.

A slide rail 113 is provided to the upper portion of the unit frame 109. The slide rail 113 made of metal is in a C-shape in cross-section, and extends from the front side to the rear side of the printer unit 100. The slide rail 113 is fixed to the unit frame 109 by a fastening member such as a screw with an opening 113*a* thereof facing upward.

Figure 9:
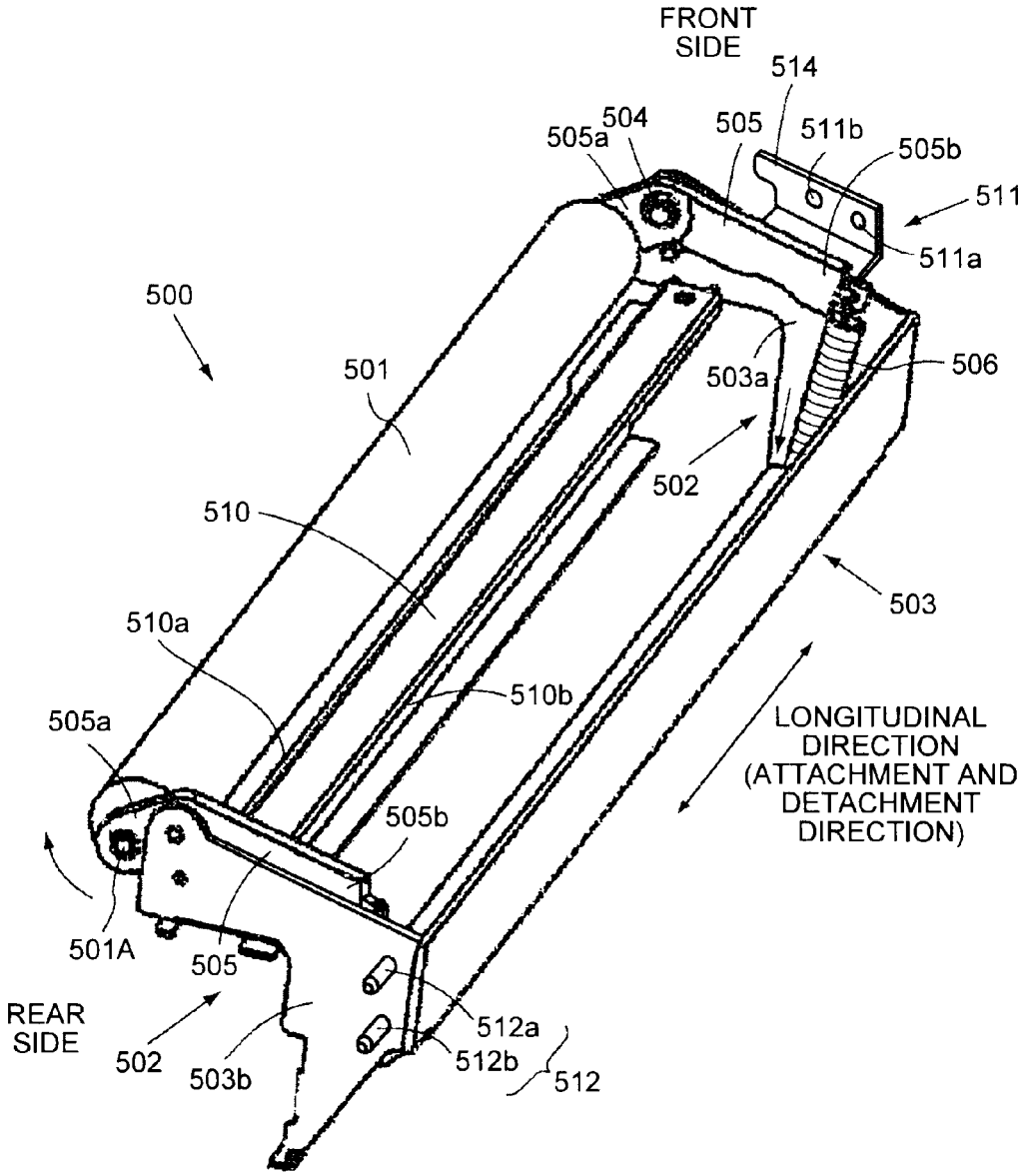
FIG. 9 is a perspective view of a configuration of the belt tensioning unit viewed from obliquely above.

The slide rail 113 houses therein a guiding member 510 in a hat-shape in cross-section provided to the belt tensioning unit 500 illustrated in FIGS. 7 and 9. The slide rail 113 is supported in a slidable manner between the front side and the rear side of the printer unit 100 with both ends of the opening 113*a* hooked on flanges 510*a* and 510*b* in a hat-shape. Specifically, if the belt tensioning unit 500 is in a fixed state, the cleaning unit 17 can move in an attachable and detachable manner to and from the belt tensioning unit 500 in a narrow sense. Furthermore, the cleaning unit 17 can move in an attachable and detachable manner to and from the belt unit 12 that supports the belt tensioning unit 500 by the first and second frames 120 and 121 in a broad sense.

As illustrated in FIG. 8, first and second attachment portions 160 and 161 for the first and second frames 120 and 121 illustrated in FIG. 6 are formed on a side plate 109*a* on the front side of the unit frame 109 and a side plate 109*b* on the rear side thereof, respectively. The first attachment portion 160 is configured by first and second holes 160*a* and 160*b* formed in the side plate 109*a* with a space interposed therebetween in the vertical direction in a state in which the cleaning unit 17 is attached to the first frame 120. The first hole 160*a* is in a circular shape, and the second hole 160*b* is an elongated hole extending in the vertical direction. The second attachment portion 161 is configured by first and second pins 161*a* and 161*b* having circular cross sections protruding toward the rear side from the side plate 109*b* with a space interposed therebetween in the vertical direction. The first and second pins 161*a* and 161*b* are disposed in a misaligned manner in the horizontal direction when the belt tensioning unit 500 is attached to the first and second frames 120 and 121. A handle 114 held by an operator when attaching and detaching the cleaning unit 17 is formed on the side plate 109*a*.

Figure 10:
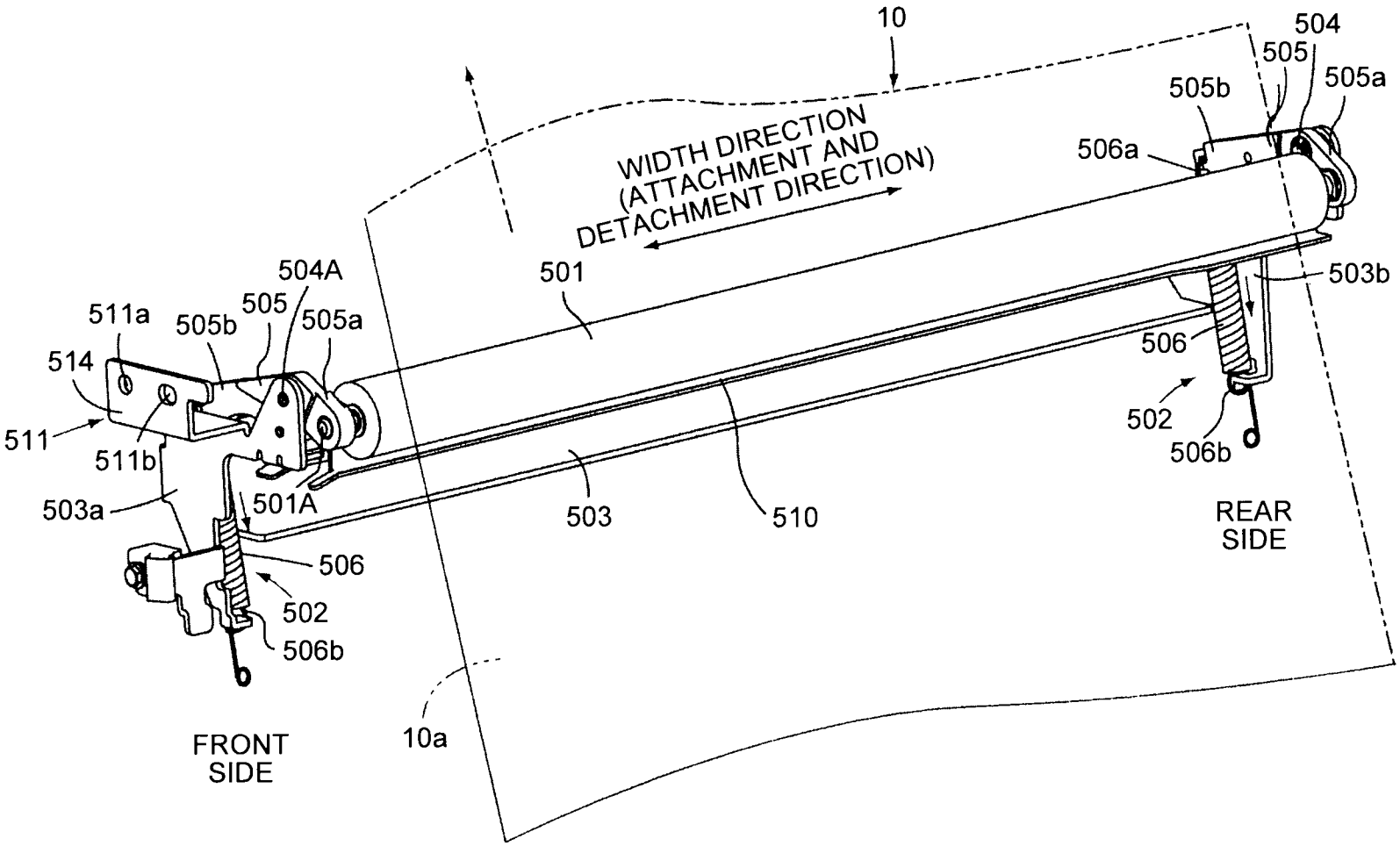
FIG. 10 is a perspective view of the configuration of the belt tensioning unit viewed from an intermediate transfer belt side.

The belt tensioning unit 500 according to the present embodiment includes a tension roller 501 serving as a tensioning member that is brought into contact with the belt surface 10*a* and a pressing unit 502 that presses the tension roller 501 against the belt surface 10*a* as illustrated in FIG. 7, FIG. 9, and FIG. 10. In the present embodiment, the first and second position adjusting units 70 and 71 are attached to the belt unit 12, and function as tension-reducing units that reduce the tension of the intermediate transfer belt 10. Therefore, the belt tensioning unit 500 includes no tension-reducing unit that releases the intermediate transfer belt 10 from a pressed state caused by the tension roller 501. The belt tensioning unit 500 can be attached to and detached from the belt unit 12 when the apparatus stops an operation.

The tension roller 501 extends in the width direction that intersects with the moving direction of the intermediate transfer belt 10. In the present embodiment, the width direction of the intermediate transfer belt 10 corresponds to the direction from the front side to the rear side of the printer unit 100, which becomes the attachment and detachment direction.

The pressing unit 502 includes an arm member 505 supported by a tensioning unit frame 503 in a rotatable manner about a shaft 504, and a helical extension spring 506 serving as a pressing member that presses the tension roller 501 against the belt surface 10*a*. The arm member 505 supports one end of a central axis 501A of the tension roller 501 in a rotatable manner by a first arm end 505*a*. The helical extension spring 506 presses the arm member 505 in an upward direction about the shaft 504 with a first spring end 506*a* attached to a second arm end 505*b* of the arm member 505 and with a second spring end 506*b* attached to the tensioning unit frame 503. In other words, the pressing unit 502 constantly biases the tension roller 501 in the pressing direction against the intermediate transfer belt 10.

In the present embodiment, the pressing units 502 configured in this manner are independently provided by being separated in the width direction of the intermediate transfer belt 10, that is, in the direction in which the tension roller 501 extends.

The guiding member 510 made of metal extends in the width direction of the intermediate transfer belt 10 in a frame area surrounded by a pair of the arm members 505 and 505 disposed on the front side and the rear side and the tensioning unit frame 503. The guiding member 510 is fixed to the tensioning unit frame 503 so as to connect a first side plate 503*a* and a second side plate 503*b* of the tensioning unit frame 503. In other words, the guiding member 510 has a function to reinforce the first and second side plates 503*a* and 503*b* of the tensioning unit frame 503 to which the shaft 504 is attached. The shaft 504 rotatably supports the arm member 505 supporting the tension roller 501 that has a heavy load. In addition, the guiding member 510 has a function to support the cleaning unit 17 serving as a movable body capable of moving in the width direction, which is the attachment and detachment direction.

As illustrated in FIG. 9 and FIG. 10, third and fourth attachment portions 511 and 512 for the first and second frames 120 and 121 illustrated in FIG. 6 are formed on the first side plate 503*a* on the front side of the tensioning unit frame 503 and the second side plate 503*b* on the rear side thereof, respectively. The third attachment portion 511 is configured by third and fourth holes 511*a* and 511*b* formed in a holder 514 obtained by folding a part of the first side plate 503*a* toward the front side so as to be located outside the first frame 120. The third and fourth holes 511*a* and 511*b* are formed with a space interposed therebetween in the horizontal direction when the belt tensioning unit 500 is attached to the first frame 120. The third hole 511*a* is in a circular shape, and the fourth hole 511*b* is an elongated hole extending in the horizontal direction. As illustrated in FIG. 9, the fourth attachment portion 512 is configured by third and fourth pins 512*a* and 512*b* having circular cross sections formed in the second side plate 503*b*. The third and fourth pins 512*a* and 512*b* are formed with a space interposed therebetween in the vertical direction when the belt tensioning unit 500 is attached to the first frame 120.

First and second positioning portions 150 and 151 to which the cleaning unit 17 is attached are formed in the first frame 120, whereas third and fourth positioning portions 152 and 153 to which the belt tensioning unit 500 is attached are formed in the second frame 121; the first and second frames 120 and 121 are illustrated in FIG. 6.

The first positioning portion 150 formed in the first frame 120 on the front side is configured by fifth and sixth pins 150*a* and 150*b*. The fifth and sixth pins 150*a* and 150*b* protrude toward the front side of the frame, and are inserted into the first and second holes 160*a* and 160*b* of the first attachment portion 160 in the cleaning unit 17 illustrated in FIG. 8 so as to support one side of the cleaning unit 17. The second positioning portion 151 formed in the second frame 121 on the rear side is configured by first and second positioning holes 151*a* and 151*b*. The first and second positioning holes 151*a* and 151*b* support the other side of the cleaning unit 17 with the first and second pins 161*a* and 161*b* of the second attachment portion 161 in the cleaning unit 17 inserted therein. The first positioning hole 151*a* is in a circular shape, and the second positioning hole 151*b* is an elongated hole extending in the vertical direction.

The third positioning portion 152 formed in the first frame 120 on the front side is configured by seventh and eighth pins 152*a* and 152*b*. The seventh and eighth pins 152*a* and 152*b* protrude toward the front side of the frame, and are inserted into the third and fourth holes 511*a* and 511*b* of the third attachment portion 511 in the belt tensioning unit 500 illustrated in FIG. 9 so as to support one side of the belt tensioning unit 500. The fourth positioning portion 153 formed in the second frame 121 is configured by third and fourth positioning holes 153*a* and 153*b*. The third and fourth positioning holes 153*a* and 153*b* support the other side of the belt tensioning unit 500 with the third and fourth pins 512*a* and 512*b* of the fourth attachment portion 512 disposed on the rear side of the belt tensioning unit 500 inserted therein. The third positioning hole 153*a* is in a circular shape, and the fourth positioning hole 153*b* is an elongated hole extending in the vertical direction.

The third positioning portion 152 formed in the first frame 120 is located inside the intermediate transfer belt 10 viewed from the front side. The fourth positioning portion 153 formed in the second frame 121 is located outside the intermediate transfer belt 10 viewed from the front side, and functions as a swinging fulcrum used for attaching and detaching the belt tensioning unit 500.

In the second positioning portion 151, the first positioning hole 151*a*, which is one of the positioning holes, functions as a main reference when the cleaning unit 17 is to be attached to the second frame 121. By contrast, the second positioning hole 151*b* functions as a sub reference when the cleaning unit 17 is to be attached to the second frame 121.

In the fourth positioning portion 153, the third positioning hole 153*a*, which is one of the positioning holes, functions as a main reference when the belt tensioning unit 500 is to be attached to the second frame 121. By contrast, the fourth positioning hole 153*b* functions as a sub reference when the belt tensioning unit 500 is to be attached to the second frame 121.

Figure 11A:
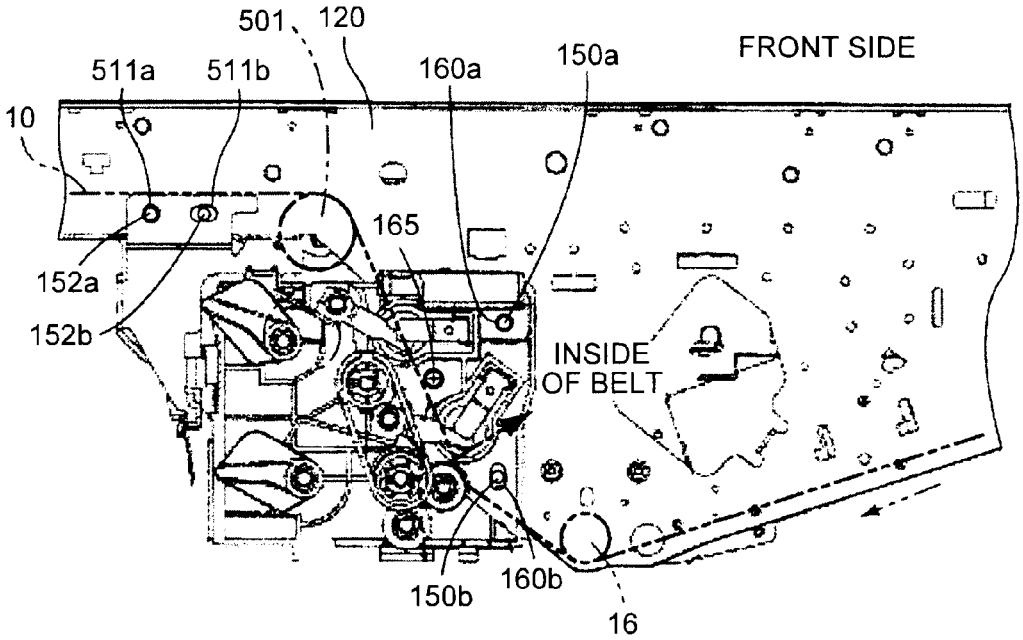
FIGS. 11A and 11B are views illustrating a supported state of the cleaning unit and the belt tensioning unit.
Figure 11B:
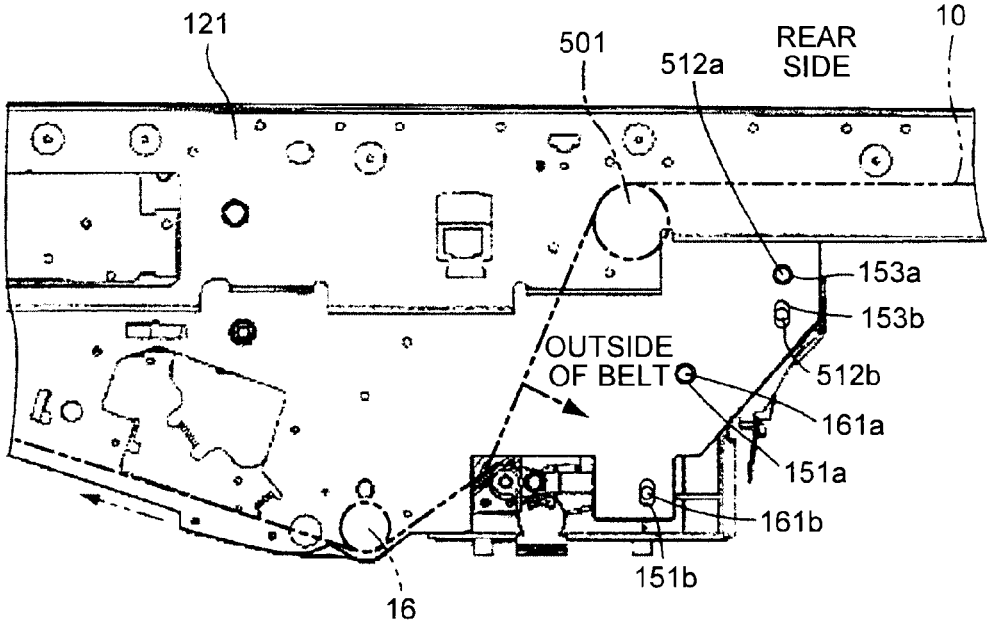

The belt tensioning unit 500 is attached to the first and second frames 120 and 121 by: inserting the third and fourth pins 512*a* and 512*b* of the fourth attachment portion 512 disposed on the rear side into the third and fourth positioning holes 153*a* and 153*b* of the fourth positioning portion 153 in the second frame 121 as illustrated in FIG. 11B; and inserting the seventh and eighth pins 152*a* and 152*b* of the third positioning portion 152 in the first frame 120 on the front side into the first and second holes 511*a* and 511*b* of the third attachment portion 511 disposed on the front side from the front side as illustrated in FIG. 11A.

Figure 12:
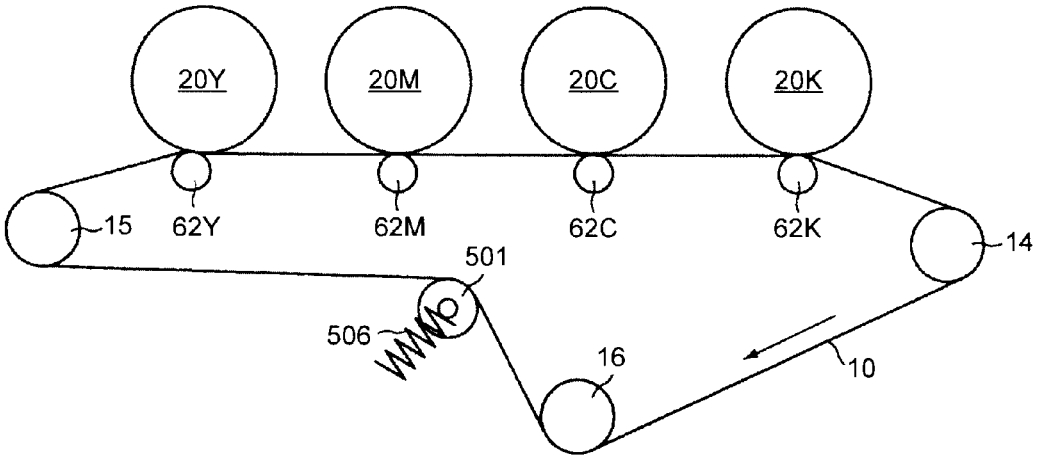
FIG. 12 is a view schematically illustrating a contacting state caused by the tension-reducing unit and a tension applying state caused by a tensioning member.

When the belt tensioning unit 500 is attached to the first and second frames 120 and 121, the tension roller 501 is pressed against the belt surface 10*a* of the intermediate transfer belt 10. At this time, the intermediate transfer belt 10 is shifted from the contact position illustrated in FIG. 12 to the second separated position illustrated in FIG. 13 by the first and second position adjusting units 70 and 71 serving as the tension-reducing units illustrated in FIG. 2 to FIG. 5C. As a result, the belt tension is made the lowest, whereby the tension roller 501 has a light load. Therefore, the belt tensioning unit 500 can be easily attached even manually.

The belt tensioning unit 500 in the attached state is detached from the first and second frames 120 and 121 by an operator by: holding the holder 514 and extracting the belt tensioning unit 500 toward the front side; canceling the engagement of the seventh and eighth pins 152*a* and 152*b* with the first and second holes 511*a* and 511*b* of the third attachment portion 511; and pulling out the third and fourth pins 512*a* and 512*b* from the third and fourth positioning holes 153*a* and 153*b*. Also when detaching the belt tensioning unit 500 from the copying machine as described above, the intermediate transfer belt 10 is located at the second separated position illustrated in FIG. 13 by the first and second position adjusting units 70 and 71. Therefore, the belt tensioning unit 500 can be easily detached even manually.

Figure 13:
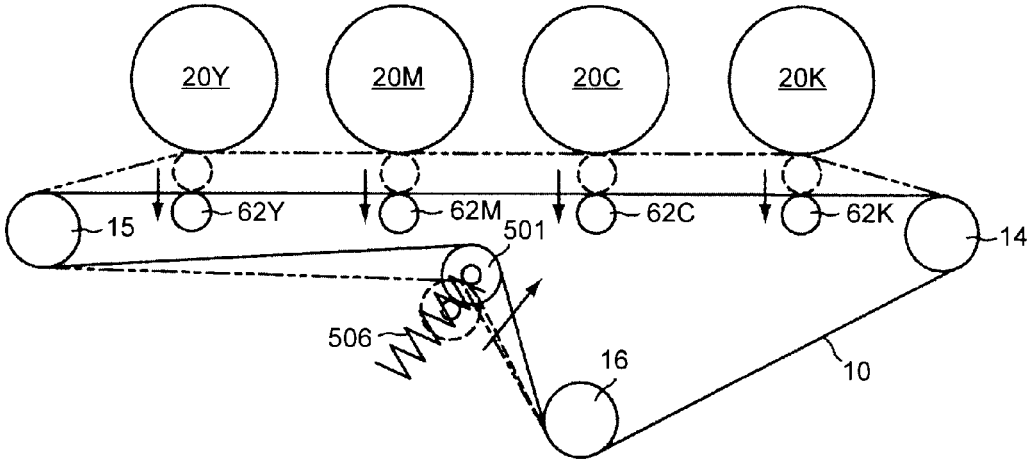
FIG. 13 is a view schematically illustrating the second separated state of the belt unit.

Furthermore, in the state where the belt tension of the intermediate transfer belt 10 is reduced significantly by the first and second position adjusting units 70 and 71 in the second separated state, if the belt tensioning unit 500 is detached from the belt unit 12, an opening space is formed below the belt unit 12. This configuration facilitates detachment and replacement of the intermediate transfer belt 10 from the driving roller 14, the driven roller 15, and the secondary transfer facing roller 16. In other words, as illustrated in FIG. 13, the belt tension of the intermediate transfer belt 10 is reduced significantly by the first and second position adjusting units 70 and 71, and the belt loosens in the second separated state. Therefore, the intermediate transfer belt 10 can be manually detached from the belt tensioning unit 500 and the belt unit 12 with ease.

Figure 14:
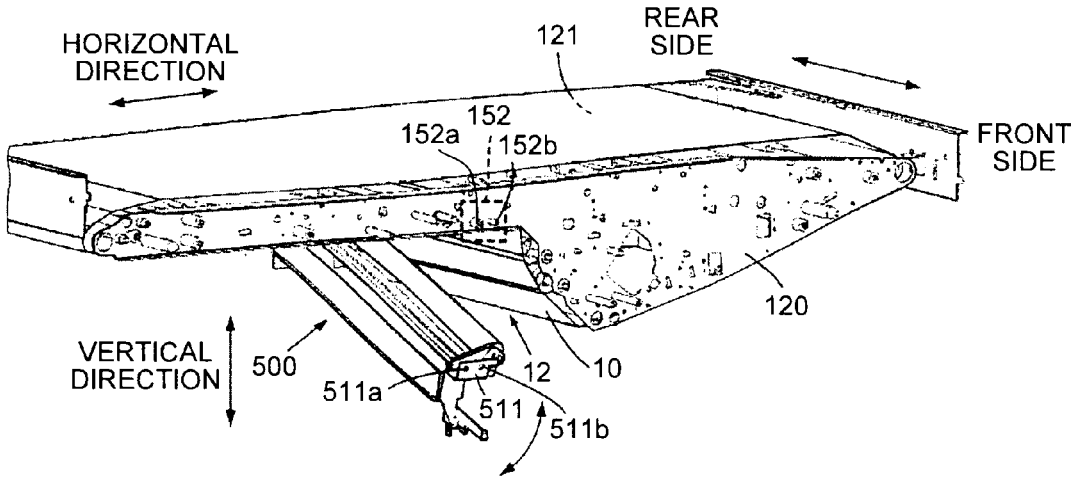
FIG. 14 is an explanatory perspective view of an operation of the belt tensioning unit that is attached to and detached from the belt unit.

In the attachment and detachment operation of the belt tensioning unit 500, the fourth positioning hole 153*b* formed below the third positioning hole 153*a* in the second frame 121 is an elongated hole extending in the vertical direction. As a result, it is possible to swing the belt tensioning unit 500 in the vertical direction with the fourth pin 512*b* of the belt tensioning unit 500 inserted into the fourth positioning hole 153*b* as illustrated in FIG. 14. In other words, one end of the belt tensioning unit 500 is supported by the second frame 121 in a swingable manner.

Figure 15:
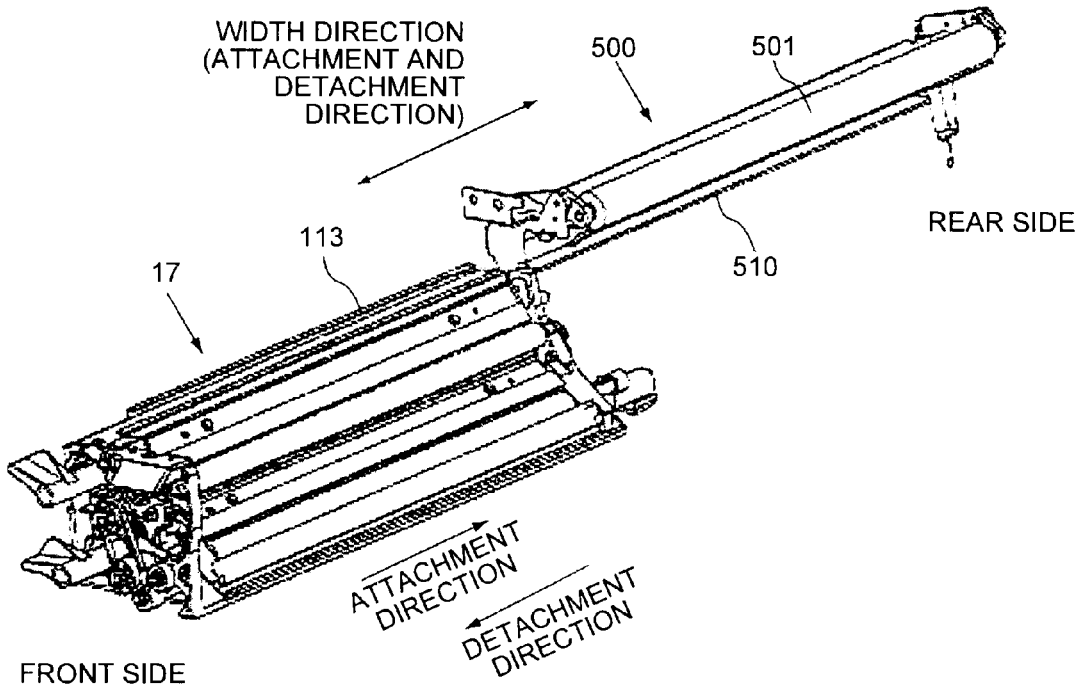
FIG. 15 is an explanatory perspective view of a state in which the cleaning unit is attached to the belt tensioning unit.
Figure 16:
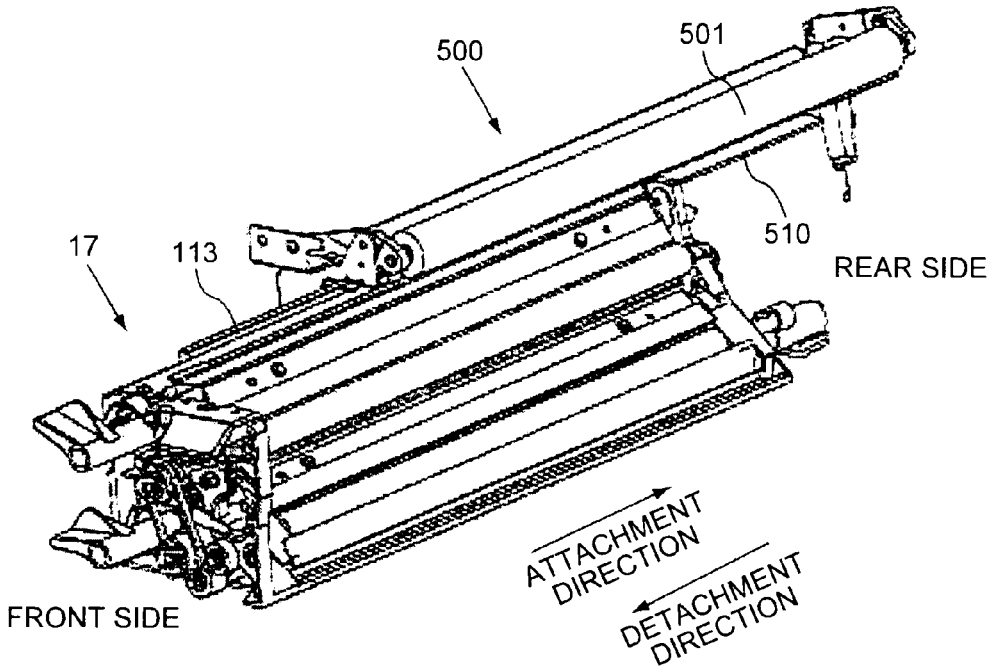
FIG. 16 is a perspective view for explaining a state in which the cleaning unit is on a way to be inserted to the rear side of the belt tensioning unit.
Figure 17:
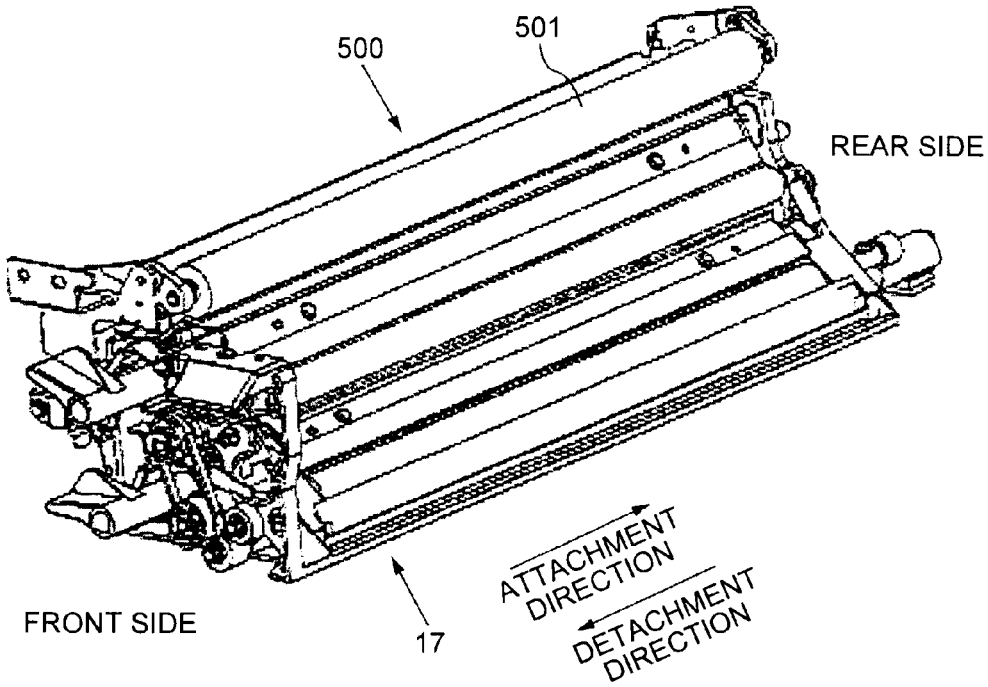
FIG. 17 is a perspective view for explaining a state in which the attachment of the belt tensioning unit is completed by inserting the cleaning unit to the belt tensioning unit until reaching the rear side thereof.

The cleaning unit 17 is attached to the copying machine by: inserting the slide rail 113 of the cleaning unit 17 from the front side into the guiding member 510 of the belt tensioning unit 500 having already been attached to the copying machine by being supported by the first and second frames 120 and 121 as illustrated in FIG. 15; thrusting the cleaning unit 17 from the front side to the rear side as illustrated in FIG. 16; causing the cleaning unit 17 to move while being hanged by the belt tensioning unit 500; and thrusting the cleaning unit 17 to an attachment completion position illustrated in FIG. 17.

When the cleaning unit 17 reaches the attachment completion position illustrated in FIG. 17, the first and second pins 161*a* and 161*b* of the cleaning unit 17 are inserted into the first and second positioning holes 151*a* and 151*b* of the second frame 121 as illustrated in FIG. 11B. In addition, the fifth and sixth pins 150*a* and 150*b* that are positioning pins of the first frame 120 are inserted into the first and second holes 160*a* and 160*b* of the first attachment portion 160 in the cleaning unit 17 as illustrated in FIG. 11A. As a result, the cleaning unit 17 shifts from the state being hanged by the belt tensioning unit 500 to another state being supported by the first and second frames 120 and 121. Subsequently, by screwing a screw 165 into the first frame 120 from the side plate 109*a* side, the cleaning unit 17 is fixed to the first frame 120. The fixation of the cleaning unit 17 restricts movement of the belt tensioning unit 500, whereby the belt tensioning unit 500 is fixed. In other words, the screw 165 is provided as an attachment and detachment restricting member that restricts attachment and detachment of the belt tensioning unit 500 to and from the belt unit 12 in a state where the cleaning unit 17 is supported by the belt tensioning unit 500. Therefore, it is possible to fix the order of attachment and detachment operations of the units. With this configuration, the belt tensioning unit 500 cannot be detached from the copying machine before removing the screw 165 and detaching the cleaning unit 17. As a result, it is possible to prevent waste toner and the like in the cleaning unit 17 from being scattered when attaching and detaching the belt tensioning unit 500 to and from the copying machine. Therefore, it is possible to prevent the apparatus and the surroundings from being stained.

As described above, the belt tensioning unit 500 does not include the first or second position adjusting units 70 or 71 serving as tension-reducing units that release the intermediate transfer belt 10 from the pressed state caused by the tension roller 501. Furthermore, the belt tensioning unit 500 can be attached to and detached from the belt unit 12 when the apparatus stops an operation. As a result, it is not necessary to cancel the tension when attaching and detaching the belt tensioning unit 500. Therefore, it is possible to facilitate replacing operation in a space-saving manner without complicating the configuration.

The pressing units 502 that press the tension roller 501 against the intermediate transfer belt 10 are independently disposed on the front side and the rear side of the apparatus, that is, both ends in the longitudinal direction of the tension roller 501. As a result, compared with the pressing performed by one pressing unit, the deviation in the tension of the intermediate transfer belt 10 is decreased between the front side and the rear side of the apparatus. Therefore, the belt tension is stabilized.

In the belt tensioning unit 500 according to the present embodiment, the guiding member 510 that supports the cleaning unit 17 for cleaning the intermediate transfer belt in a slidable manner in the attachment and detachment direction is provided in the frame area surrounded by the pair of the arm members 505 and 505 disposed on the front side and the rear side and the tensioning unit frame 503. This configuration makes it possible to limit the sliding function of the cleaning unit 17 within the projected area of the belt tensioning unit 500, thereby achieving space-saving.

In the belt tensioning unit 500 according to the present embodiment, the tension roller 501 is brought into contact with the intermediate transfer belt 10 from the belt surface 10*a* side positioned outside the loop thereof toward the inside of the loop. This configuration makes the space occupied by the intermediate transfer belt 10 (belt unit 12) smaller than that in the configuration in which the tension roller 501 is brought into contact with the intermediate transfer belt 10 from the inside of the loop thereof. Therefore, it is possible to achieve space-saving. Furthermore, the belt tensioning unit 500 supporting the tension roller 501 that is brought into contact with the belt surface 10*a* of the intermediate transfer belt 10 is disposed close to the cleaning unit 17, and the cleaning unit 17 can be attached to and detached from the belt tensioning unit 500. With this configuration, the workability in attachment and detachment of the cleaning unit 17 is improved. Therefore, it is possible to achieve space-saving for the attachment and detachment mechanisms of the both units.

In the belt tensioning unit 500 according to the present embodiment, the tensioning unit frame 503 includes the guiding member 510 for attaching and detaching the cleaning unit 17, and the slide rail 113 guided by the guiding member 510 is provided to the cleaning unit 17. With this configuration, it is possible to achieve space-saving compared with the case where these sliding mechanisms are formed independently of the units.

In the present embodiment, the intermediate transfer belt 10 can be brought into contact with and separated from the photosensitive elements 20Y, 20M, 20C, and 20K. In addition, the first and second position adjusting units 70 and 71 serving as the tension-reducing units cause the intermediate transfer belt 10 to be separated from the photosensitive elements 20Y, 20M, 20C, and 20K as illustrated in FIG. 13 in a tension reducing operation. Furthermore, the belt unit 12 can be attached to and detached from the printer unit 100 after the tension reducing operation. With this configuration, it is possible to widely separate the intermediate transfer belt 10 from each of the photosensitive elements 20Y, 20M, 20C, and 20K simultaneously with cancellation of the belt tension. As a result, it is possible to improve the attachability and detachability of the image forming units 18Y, 18M, 18C, and 18K that include the respective photosensitive elements 20Y, 20M, 20C, and 20K and the attachability and detachability of the belt unit (intermediate transfer unit) 12, and to cancel the belt tension in one operation. Therefore, the number of components and the costs can be reduced.

In the present embodiment, a first end of the belt tensioning unit 500 is supported by the second frame 121 on the rear side of the belt unit 12 in a swingable manner. With this configuration, even if a second end of the belt tensioning unit 500 is removed from the first frame 120, the first end of the belt tensioning unit 500 is supported by the second frame 121. As a result, it is possible to reduce the weight of the belt tensioning unit 500 received by the operator while attaching and detaching the belt tensioning unit 500, whereby the operability is improved. Furthermore, the swinging fulcrum used for attaching and detaching the belt tensioning unit 500 is positioned on the rear side of the printer unit 100. This configuration allows the operator to attach and detach the belt tensioning unit 500 with small strength when performing the operation on the front side. Therefore, the workability is improved.

In the present embodiment, the fourth positioning hole 153*b*, which is an elongated hole, is used as the sub reference, and the third positioning hole 153*a* in a circular shape to which the third pin 512*a* is inserted is used as the main reference between the third and fourth positioning holes 153*a* and 153*b* that form the fourth positioning portion 153 of the belt tensioning unit 500. With this configuration, the attachability and detachability of the belt tensioning unit 500 is improved.

In the present embodiment, because the attachment and detachment of the belt tensioning unit 500 are performed when the intermediate transfer belt 10 is attached to the belt unit 12, the operator performs the operation while viewing the intermediate transfer belt 10 from below as illustrated in FIG. 14. Therefore, the third and fourth positioning holes 153*a* and 153*b* of the fourth positioning portion 153 are disposed to be separated from each other in the vertical direction on the rear side. This configuration allows the third and fourth positioning holes 153*a* and 153*b* serving as the targets to be brought into sight when inserting the third and fourth pins 512*a* and 512*b* of the belt tensioning unit 500 into the third and fourth positioning holes 153*a* and 153*b*. Therefore, the workability in assembling is improved.

Figure 18:
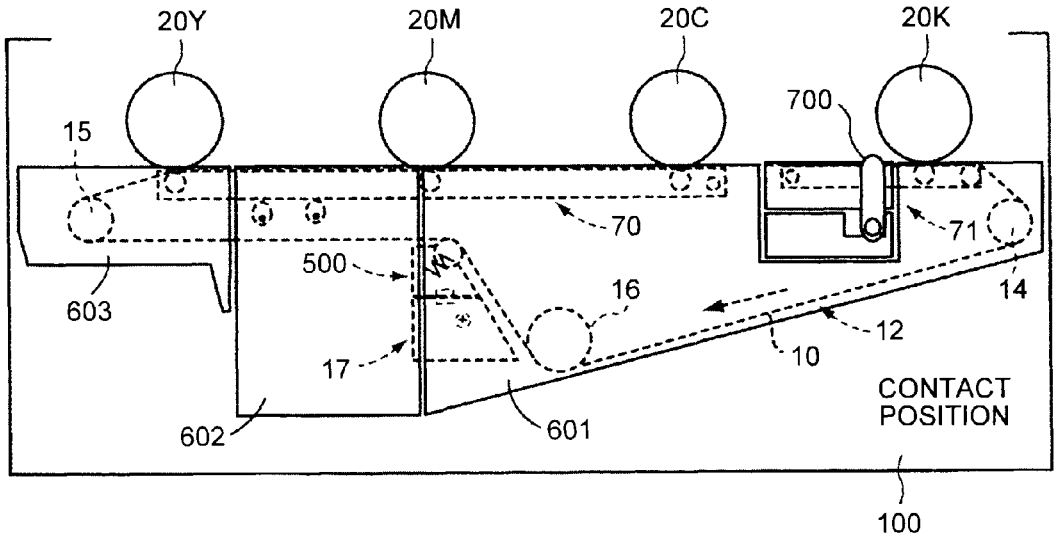
FIG. 18 is a schematic diagram for explaining an interference state between an inner cover provided to the image forming apparatus main body and an operation lever with which the tension-reducing unit is manually operated.

The printer unit 100 of the copying machine according to the present embodiment includes the first inner cover 601 to the third inner cover 603 as illustrated in FIG. 18. The first inner cover 601 to the third inner cover 603 cover the belt unit 12, the belt tensioning unit 500, and the cleaning unit 17 from the front side of the printer unit, and can be attached to and detached from the printer unit 100. The first to third inner covers 601 to 603 are exposed by opening an outer cover, which is not illustrated, provided to the printer unit 100. In FIGS. 18 to 21, illustration of the first and second frames 120 and 121 is omitted.

Figure 19:
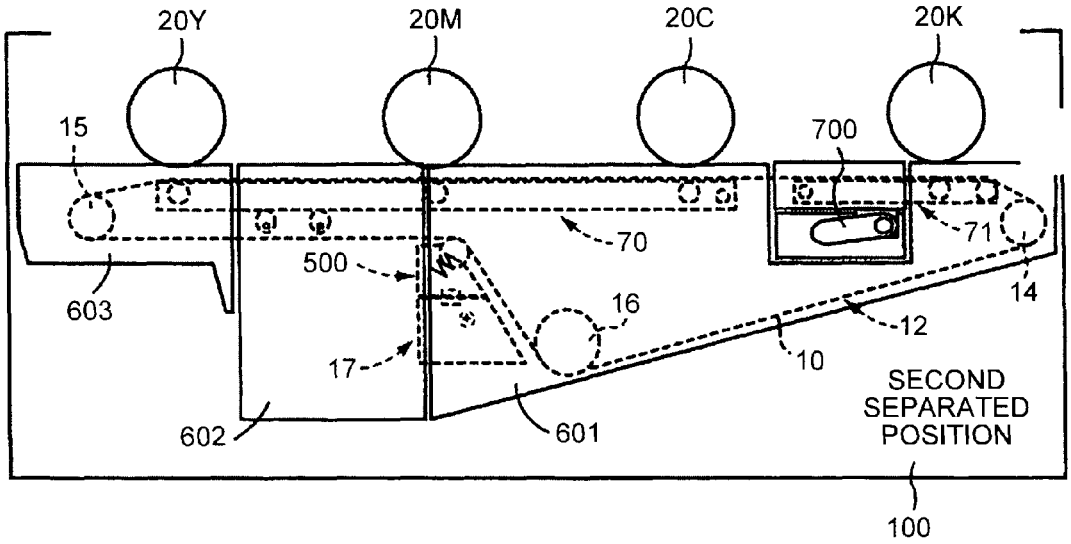
FIG. 19 is a schematic diagram for explaining a non-interference state between the inner cover and the operation lever in the second separated state.

As described above, the first and second position adjusting units 70 and 71 serving as the tension-reducing units include the operation lever 700 used for operating the cams when moving the intermediate transfer belt 10, the primary transfer rollers 62Y, 62M, 62C, and 62K, and the like from the first separated position to the second separated position. The operation lever 700 is disposed outside the first inner cover 601 as illustrated in FIG. 18, and can be operated without detaching the first inner cover 601. When the tension is not reduced, that is, when the intermediate transfer belt 10, the primary transfer rollers, and the like are located at the contact position, the operation lever 700 engages and interferes with the first inner cover 601 such that the first inner cover 601 cannot be detached from the printer unit 100. As illustrated in FIG. 19, if the operation lever 700 is operated to rotate in the counterclockwise direction in FIG. 19, the intermediate transfer belt 10, the primary transfer rollers, and the like are shifted to the second separated position. When the operation lever 700 is moved to the separation completion position illustrated in FIG. 19 and the intermediate transfer belt 10, the primary transfer rollers, and the like are brought into the tension-reduced state, the interference of the operation lever 700 with the first inner cover 601 can be avoided, whereby the first inner cover 601 can be attached or detached. In other words, the first inner cover 601 is disposed to be capable of being engaged with and separated from the operation lever 700.

In the present embodiment, the first inner cover 601 covers approximately half of the belt unit 12, and also a part of the cleaning unit 17 and the belt tensioning unit 500 from the front side of the apparatus. The second inner cover 602 covers the belt tensioning unit 500, the cleaning unit 17, and the central portion of the belt unit 12 from the front side of the apparatus. The third inner cover 603 mainly covers the driven roller 15 side of the belt unit 12 from the front side of the apparatus.

Figure 20:
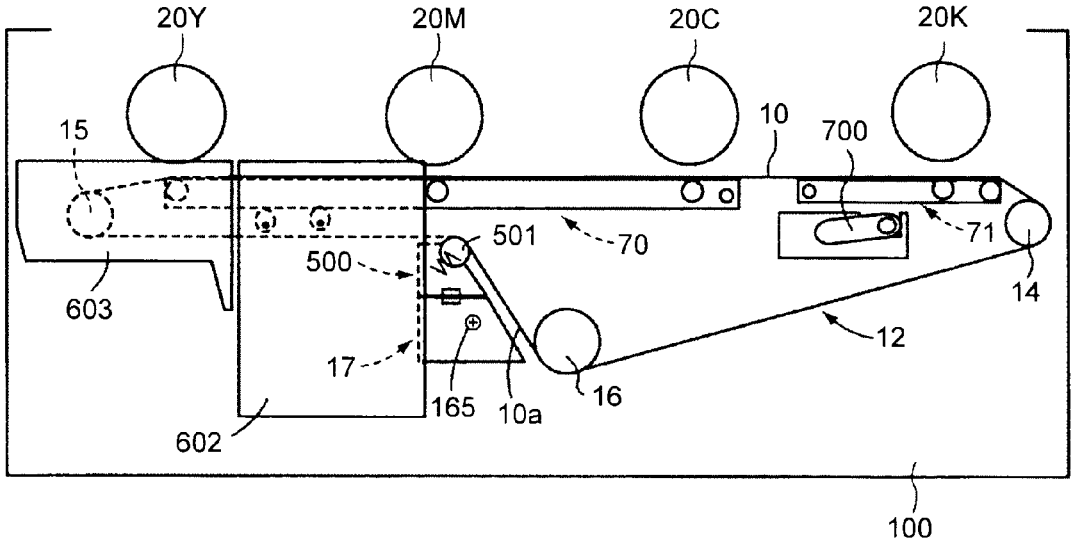
FIG. 20 is a schematic diagram for explaining a state in which a part of the inner cover interferes with the belt tensioning unit and the cleaning unit.
Figure 21:
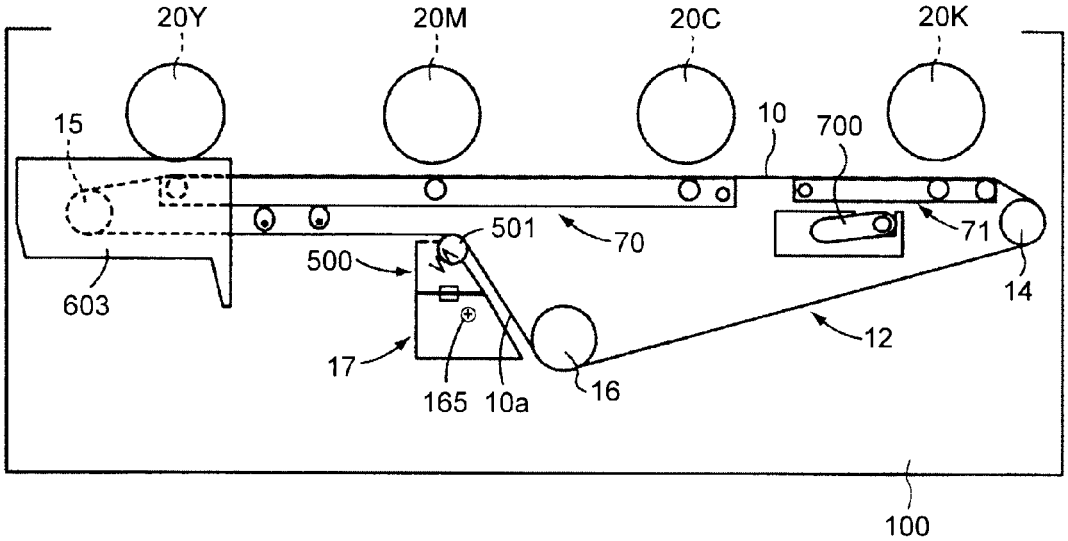
FIG. 21 is a schematic diagram for explaining a state in which the belt tensioning unit and the cleaning unit are attachable and detachable by removing the inner cover interfering therewith.

Among the first to third inner covers 601 to 603, a part of the second inner cover 602 interferes with the belt tensioning unit 500 in the attached state as illustrated in FIG. 20. Thus, the second inner cover 602 restricts attachment and detachment of the belt tensioning unit 500 to and from the copying machine. In order to attach and detach the belt tensioning unit 500, both the first and second inner covers 601 and 602 are configured to be removed as illustrated in FIG. 21.

As described above, the first inner cover 601 cannot be removed from the printer unit 100 (copying machine) unless the operation lever 700 is operated to be located at the separation completion position. With this configuration, if the copying machine is operating, and the intermediate transfer belt 10, the primary transfer rollers, and the like are located at the contact position, the first inner cover 601 cannot be removed. Therefore, it is possible to prevent the apparatus in operation from being operated in an unintended way. Furthermore, a part of the second inner cover 602 interferes with a part of the cleaning unit 17 and the belt tensioning unit 500. With this configuration, the belt tensioning unit 500 and the cleaning unit 17 cannot be attached and detached unless the second inner cover 602 is removed. As a result, it is possible to prevent the belt tensioning unit 500 and the cleaning unit 17 from being attached and detached when the intermediate transfer belt 10, the primary transfer rollers, and the like are located at the contact position, and when the belt tension is high. Therefore, the durability of the intermediate transfer belt 10 and the tension roller 501 can be improved.

In the present embodiment, the intermediate transfer belt 10 is used as an example of the belt-shaped image carrier, and the explanation has been given of the case where the belt tensioning unit 500 is used for the intermediate transfer belt 10. However, a belt-shaped photosensitive element may be used as the belt-shaped image carrier. Even if the belt tensioning unit 500 is used for such a belt-shaped photosensitive element, similar advantageous effects to those in the present embodiment can be achieved. Furthermore, even if the cleaning unit 17 according to the present embodiment is used not as a cleaning unit for the intermediate transfer belt 10 but as a cleaning unit for such a belt-shaped photosensitive element, similar advantageous effects to those in the present embodiment can be achieved.

According to the present embodiment, it is possible to facilitate the replacement in a space-saving manner without complicating the configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a belt unit that includes a belt-shaped image carrier stretched around a plurality of rollers;

a belt tensioning unit that includes a tensioning member that is brought into contact with an image carrying surface of the belt-shaped image carrier and applies tension to the belt-shaped image carrier, wherein the belt tensioning unit is attachable to and detachable from the belt unit;

a cleaning unit that includes a cleaning member that is brought into contact with the image carrying surface of the belt-shaped image carrier and cleans the image carrying surface, wherein the cleaning unit is supported by the belt tensioning unit in an attachable and detachable manner; and a restricting member that restricts the belt tensioning unit to be attached and detached from the belt unit when the cleaning unit is supported by the belt tensioning unit.

2. The image forming apparatus according to claim 1, wherein the belt tensioning unit includes a guiding member that guides the cleaning unit in an attachment and detachment direction of the cleaning unit.

3. The image forming apparatus according to claim 2, wherein the belt tensioning unit includes a pair of arm members, each arm member having a first end that supports the tensioning member, a tensioning unit frame that supports the pair of arm members in a rotatable manner, and one or more pressing members, each of the pressing members being attached at one end to a second end of a corresponding arm member and at another end to the tensioning unit frame such that the one or more pressing members presses the tensioning member against the belt-shaped image carrier, and the guiding member is disposed in an area surrounded by the pair of arm members and the tensioning unit frame.

4. The image forming apparatus according to claim 1, further comprising a tension-reducing unit that reduces tension applied to the belt-shaped image carrier that is stretched around the rollers independently of the belt tensioning unit, wherein the belt tensioning unit is attached to and detached from the belt unit after the tension applied to the belt-shaped image carrier is reduced by the tension-reducing unit.

5. The image forming apparatus according to claim 4, further comprising a latent image carrier that is capable of being brought into contact with and separated from the belt-shaped image carrier, and that is attachable to and detachable from a main body of the image forming apparatus, wherein a tension reducing operation performed by the tension-reducing unit is an operation for separating the belt-shaped image carrier from the latent image carrier, and at least the belt unit is attachable to and detachable from the main body of the image forming apparatus after the tension reducing operation.

6. The image forming apparatus according to claim 5, wherein the main body of the image forming apparatus includes an inner cover that covers the belt unit, the belt tensioning unit, and the cleaning unit from a front side of the image forming apparatus, and that is attachable to and detachable from the main body of the image forming apparatus, and the tension-reducing unit includes an operation lever that avoids interference with the inner cover when tension is reduced and that interferes with the inner cover when tension is not reduced.

7. The image forming apparatus according to claim 5, wherein the belt unit includes a first frame on a front side and a second frame on a rear side of the main body of the image forming apparatus, and one end of the belt tensioning unit is supported by the second frame on the rear side of the main body of the image forming apparatus in a swingable manner.

8. The image forming apparatus according to claim 7, wherein a first positioning portion and a second positioning portion to which the belt tensioning unit is attached are formed in the first and second frames on the front side and the rear side, respectively, and the first positioning portion formed in the first frame on the front side is located inside the belt-shaped image carrier when viewed from the front side of the main body of the image forming apparatus, and the second positioning portion formed in the second frame on the rear side is located outside the belt-shaped image carrier and functions as a swinging fulcrum used for attaching and detaching the belt tensioning unit.

9. The image forming apparatus according to claim 8, wherein the first positioning portion formed in the first frame on the front side is configured by two positioning pins and the second positioning portion formed in the second frame on the rear side is configured by two portions that define positioning holes, one of the positioning holes is a main reference for attaching the belt tensioning unit and another one of the positioning holes is a sub reference for attaching the belt tensioning unit, one of the positioning pins is another main reference for attaching the belt tensioning unit and another one of the positioning pins is another sub reference for attaching the belt tensioning unit, and the positioning holes are formed by being aligned in a vertical direction and the positioning pins are formed by being aligned in a horizontal direction.

10. The image forming apparatus according to claim 8, wherein the main body of the image forming apparatus includes a first inner cover that covers the belt unit and the cleaning unit from a front side of the image forming apparatus and that is attachable to and detachable from the main body of the image forming apparatus, and a second inner cover that covers the belt tensioning unit from the front side of the image forming apparatus and that is attachable to and detachable from the main body of the image forming apparatus such that a part of the second inner cover interferes with the belt tensioning unit at least in an attached state.

11. A belt tensioning unit provided in a main body of an image forming apparatus, the belt tensioning unit comprising:

a tensioning unit frame including first and second pins spaced apart in a vertical direction;

a tensioning member that is brought into contact with an image carrying surface of a belt-shaped image carrier that is stretched around and driven to rotate by a plurality of rollers; and a pressing unit that presses the tensioning member against the image carrying surface of the belt-shaped image carrier, wherein the belt tensioning unit, having no tension-reducing unit that releases the belt-shaped image carrier from a pressed state caused by the tensioning member, is attachable to one of the main body of the image forming apparatus and a belt unit that includes the belt-shaped image carrier when the image forming apparatus stops an operation by engagement of the first and second pins with first and second holes in the one of the main body and the belt unit, and is detachable from the one of the main body and the belt unit by disengagement of the first and second pins from the first and second holes in the one of the main body and the belt unit.

12. The belt tensioning unit according to claim 11, wherein the tensioning member extends in a width direction of the belt-shaped image carrier, and a plurality of the pressing units is disposed independently of each other in the width direction of the belt-shaped image carrier.

13. The belt tensioning unit according to claim 11, further comprising:

a pair of arm members that supports both ends of the tensioning member by a first end thereof;

a tensioning unit frame that supports the pair of arm members in a rotatable manner;

a pressing member that is attached at both ends thereof to a second end of the pair of arm members and to the tensioning unit frame and that presses the tensioning member against the belt-shaped image carrier; and a guiding member that is provided in an area surrounded by the pair of arm members and the tensioning unit frame, that extends in a width direction of the belt-shaped image carrier, that reinforces the tensioning unit frame, and that supports a movable body in a movable manner in the width direction of the belt-shaped image carrier.

14. The belt tensioning unit according to claim 11, wherein the belt tensioning unit is supported by first and second frames provided, respectively, to the belt unit on a front side and a rear side of the main body of the image forming apparatus, and one end of the belt tensioning unit is supported by the second frame on the rear side in a swingable manner.

15. An image forming apparatus comprising:

a belt unit that includes a belt-shaped image carrier that is stretched around and driven to rotate by a plurality of rollers; and a belt tensioning unit that includes a tensioning member that is brought into contact with an image carrying surface of the belt-shaped image carrier and a pressing unit that presses the tensioning member against the image carrying surface of the belt-shaped image carrier, wherein the image forming apparatus includes the belt tensioning unit according to claim 12 as a belt tensioning unit.

16. An image forming apparatus comprising:

a belt supported by a plurality of rollers;

a belt frame to support the plurality of rollers, the belt frame including a pin;

a tension roller frame to support a tension roller that applies tension to the belt, the tension roller frame including a guiding frame;

and a cleaner frame to support a cleaner that cleans the belt, the cleaner frame including a slide rail and a hole, wherein the cleaner frame is positioned to the belt frame by engaging the pin of the belt frame with the hole of the cleaner frame after insertion of the slide rail into the guiding frame.

17. The image forming apparatus according to claim 16, wherein the tension roller frame is detachably attached to the belt frame.

18. The image forming apparatus according to claim 16, wherein the tension roller contacts with an outer surface of the belt.

19. The image forming apparatus according to claim 16, wherein the guiding frame and the slide rail extend in an axial direction of the tension roller.

20. The image forming apparatus according to claim 16, further comprising:

an arm member that supports the tension roller and is rotatable about a shaft; and a spring having a first end attached to the arm member and a second end attached to the tension roller frame, wherein the arm member, the spring, and the tension roller frame are integrally detachable from the belt frame.

21. An image forming apparatus comprising:

a belt supported by a plurality of rollers;

a belt unit frame to support the plurality of rollers, the belt unit frame including a hole;

a tension roller frame to support a tension roller that applies tension to the belt, the tension roller frame including a guiding frame; and a cleaner frame to support a cleaner that cleans the belt, the cleaner frame including a slide rail and a pin, wherein the cleaner frame is positioned to the belt frame by engaging the pin of the cleaner frame with the hole of the belt frame after insertion of the slide rail into the guiding frame.

22. The image forming apparatus according to claim 21, wherein the tension roller frame is detachably attached to the belt frame.

23. The image forming apparatus according to claim 21, wherein the tension roller contacts with an outer surface of the belt.

24. The image forming apparatus according to claim 21, wherein the guiding frame and the slide rail extend in an axial direction of the tension roller.

25. The image forming apparatus according to claim 21, further comprising:

an arm member that supports the tension roller and is rotatable about a shaft; and a spring having a first end attached to the arm member and a second end attached to the tension roller frame, wherein the arm member, the spring, and the tension roller frame are integrally detachable from the belt frame.

* * * * *